US008328579B2

(12) United States Patent
Sasaki et al.

(10) Patent No.: US 8,328,579 B2
(45) Date of Patent: Dec. 11, 2012

(54) SHIELD CASE AND CONNECTOR HAVING THE SAME

(75) Inventors: Daisuke Sasaki, Yao (JP); Junichi Arai, Isesaki (JP)

(73) Assignee: Hosiden Corporation, Yao-shi (JP)

( * ) Notice: Subject to any disclaimer, the term of this patent is extended or adjusted under 35 U.S.C. 154(b) by 0 days.

(21) Appl. No.: 13/082,614

(22) Filed: Apr. 8, 2011

(65) Prior Publication Data

US 2011/0263150 A1 Oct. 27, 2011

(30) Foreign Application Priority Data

Apr. 27, 2010 (JP) ..... 2010-101767

(51) Int. Cl.
*H01R 13/648* (2006.01)

(52) U.S. Cl. ..... 439/607.25; 439/607.55

(58) Field of Classification Search ..... 439/607.23–607.25, 607.41–607.52, 439/607.55–607.57
See application file for complete search history.

(56) References Cited

U.S. PATENT DOCUMENTS

| | | | | |
|---|---|---|---|---|
| 6,099,351 | A * | 8/2000 | Wu | 439/607.43 |
| 6,383,024 | B1 * | 5/2002 | Wang et al. | 439/607.23 |
| 6,503,102 | B1 * | 1/2003 | Zhang et al. | 439/607.55 |
| 6,939,177 | B2 * | 9/2005 | Kato et al. | 439/638 |
| 7,614,920 | B1 * | 11/2009 | Yi | 439/682 |
| 7,850,477 | B2 * | 12/2010 | Koyama et al. | 439/358 |
| 7,946,887 | B1 * | 5/2011 | Zhang et al. | 439/607.23 |
| 8,011,959 | B1 * | 9/2011 | Tsai et al. | 439/607.25 |
| 8,011,960 | B2 * | 9/2011 | Xiao et al. | 439/607.56 |
| 8,033,866 | B2 * | 10/2011 | Mao et al. | 439/638 |
| 8,118,497 | B2 * | 2/2012 | Yi | 385/93 |
| 8,123,562 | B2 * | 2/2012 | Zhou et al. | 439/607.48 |
| 8,142,226 | B2 * | 3/2012 | Xiao et al. | 439/607.56 |
| 8,162,694 | B2 * | 4/2012 | Hisada et al. | 439/607.23 |
| 2002/0048992 | A1 * | 4/2002 | Wang et al. | 439/607 |
| 2004/0127099 | A1 * | 7/2004 | Lin et al. | 439/610 |
| 2010/0062653 | A1 * | 3/2010 | Mao et al. | 439/660 |
| 2010/0112863 | A1 * | 5/2010 | Xiao et al. | 439/607.27 |
| 2010/0158449 | A1 * | 6/2010 | Yi | 385/75 |
| 2011/0263150 | A1 * | 10/2011 | Sasaki et al. | 439/345 |
| 2011/0312217 | A1 * | 12/2011 | Xiao et al. | 439/607.23 |
| 2012/0009824 | A1 * | 1/2012 | Sasaki et al. | 439/638 |
| 2012/0034803 | A1 * | 2/2012 | Sasaki et al. | 439/345 |

FOREIGN PATENT DOCUMENTS

JP 2009-277497 A1 11/2009

* cited by examiner

*Primary Examiner* — Ross Gushi
(74) *Attorney, Agent, or Firm* — Kratz, Quintos & Hanson, LLP

(57) ABSTRACT

The invention provides a shield case to cover a body, the body having a main body and first and second connecting portions projecting from the main body and lying adjacent to each other along a first direction. The shield case includes first to forth conductive shells. The first and second shells cover an outer circumference of the main body; the third shell covers the first connecting portion; and the fourth shell covers the second connecting portion. The third shell is in contact with at least one of the first and second shells. The first or fourth shell is in contact with the second shell. The fourth shell is provided integrally with the first shell and is adjacent to the third shell along the first direction. The first or fourth shell may not contact the second shell if the third shell is contactable with both the first and second shells.

31 Claims, 9 Drawing Sheets

SHIELD CASE AND CONNECTOR HAVING THE SAME

The present application claims priority under 35 U.S.C. §119 of Japanese Patent Application Nos. 2010-101767 filed on Apr. 27, 2010, the disclosure of which is expressly incorporated by reference herein in their entity.

BACKGROUND OF THE INVENTION

1. Technical Field

The present invention relates to connectors having two adjacent connecting portions, and particularly to a shield cases of the same connectors.

2. Background Art

A conventional plug connector of this type includes a body having a main body and first and second connecting portions, first and second metal shells covering an outer circumference of the main body, and a tuboid third metal shell covering outer circumferences of the first and second connecting portions, as disclosed in paragraph 0021 and FIG. 5 of Patent Literature 1. The plug connector may be connectable with a receptacle connector including a tuboid metal shell having an internal space partitioned into first and second slots with a bent portion formed by bending a central portion of a bottom plate of the metal shell toward a top plate. The first and second slots of the receptacle are adapted to fittingly receive the first and second connecting portions of the plug connector. A clearance is provided between the bent portion and the top plate of the metal shell of the receptacle connector so that the first and second slots partially communicate with each other. To avoid interference with the bent portion, the third metal shell of the plug connector is configured such that a central portion of a bottom plate is bent so as to contact a top plate.

Another conventional receptacle connector is configured such that the bent portion of the metal shell abuts the top plate, without clearance between the bent portion and the top plate, in other words, the first and second slots are completely partitioned with the bent portion. To be compatible with such a receptacle connector without interfering with its bent portion, the above plug connector may be modified to replace the third metal shell with fourth and fifth tuboid metal shells to cover circumferences of the first and second connecting portions.

CITATION LIST

Patent Literature 1: Japanese Unexamined Patent Publication No. 2009-277497

SUMMARY OF INVENTION

Unfortunately, the plug connector including the first, second, fourth and fifth metal shells would have increased number of components, fabricated in increased assembling man-hours and therefore at increased cost. Moreover, the first, second, fourth and fifth metal shells of the plug connector need to be electrically connected to one another to address electro-magnetic interference (EMI). The time and man-power for electrically connecting the four metal shells would further increase the cost of the plug connector.

The present invention has been devised in view of the above-described situation. The present invention provides a shield case and a connector that are compatible with a mating connector with completely partitioned first and second slots, that can be fabricated with reduced number of components and in reduced assembling man-hours, and that have shells adapted for easy electric connection therebetween.

In order to solve the above-described problem, the invention provides a shield case to cover a body, the body having a main body and first and second connecting portions projecting from the main body and lying adjacent to each other along a first direction. The shield case includes: first and second shells, having conductive properties and being adapted to cover an outer circumference of the main body; a third shell, having a conductive property and being adapted to cover the first connecting portion; and a fourth shell, having a conductive property and being adapted to cover the second connecting portion. The third shell is in contact with at least one of the first and second shells. The first or fourth shell is in contact with the second shell. The fourth shell is provided integrally with the first shell and is adjacent to the third shell along the first direction. The first or fourth shell may not be contactable with the second shell if the third shell is contactable with both the first and second shells.

In the above-described shield case, the fourth shell is provided integrally with the first shell, so that it is possible to reduce the number of components and further reduce the assembling man-hours of a connector having the present shield case, compared with the above conventional connectors. Moreover, as the fourth shell is integrated with the first shell, electrical connection between the first, second, third and fourth shells can be established with ease, simply by bringing the first or fourth shell into contact with the second shell and bringing the third shell into contact with at least one of the first and second shells, or alternatively, by bringing the third shell into contact with both the first and second shells. The invention can thus facilitate the electrical connection between the shells, compared with the conventional connector with four shells that need to be brought into contact with one another. Moreover, as the third and fourth shells are provided independently for covering the first and second connecting portion, respectively, a connector including the present shield case is adapted to mate with a connector with completely partitioned first and second slots. Furthermore, the fourth shell integrated with the first shell should have an improved prying resistance.

The first and second shells may each include a base, the base including first and second ends in the first direction and first and second ends in a second direction perpendicular to the first direction. The third shell may include: a shell body of tuboid shape, adapted to cover the first connecting portion; and a contact portion, being provided in the shell body and in contact with the first end in the second direction of the base of at least one of the first and second shells. The fourth shell may include: a shell body, adapted to cover the second connecting portion; and a joining portion, joining the shell body of the forth shell and the first end in the second direction of the base of the first shell. In this aspect of invention, electrical connection can be established with ease between the third shell and at least one of the first and second shells, simply by covering the first connecting portion with the shell body of the third shell and bringing the contact portion into contact with the first end in the second direction of at least one of the first and second shells. This configuration also facilitates electrical connection between the shells.

If the main body of the body includes first and second surfaces that are opposed along a third direction perpendicular to the first and second directions, at least one of the first and second shells may further include first and second side walls. The first and second side walls may stand upright at the first and second ends in the first direction of the base of the at least one of the first and second shells. The base of the first shell may be abuttable on the first surface of the main body. The base of the second shell may be abuttable on the second surface of the main body. This aspect of the invention can facilitate assembly of a connector including the present shield case. More particularly, the first and second shells can cover the outer circumference of the main body of the body, simply by bringing the bases of the first and second shell into abutment with the first and second surfaces of the main body of the body.

The fourth shell may further include a contact portion provided at the shell body. The contact portion may be in contact with the first end in the second direction of the second shell. In this aspect of the invention, electrical connection of the first and fourth shells to the second shell can be established with ease, simply by bringing the contact portion of the fourth shell into contact with the first end in the second direction of the second shell. This aspect of the invention also facilitates the electrical connection between the shells.

The shield case may include a first locking piece, provided on one side in the first direction of the fourth shell; and a second locking piece, provided on the other side in the first direction of the fourth shell. In this aspect of the invention, the first and second locking pieces as locked by the counterpart connector can maintain a state where the first and second connecting portions and the third and fourth shells are fitted in the first and second slots of the mating connector.

The first and second locking pieces may preferably be provided integrally with the first or second shell. In this aspect of the invention, the shield case with the first and second locking pieces can still be fabricated with a reduced number of components because the first and first and second locking pieces are integrated with the first or second shell. A connector including the present shield case can also be fabricated in reduced assembling man-hours.

The shield case may further include a first release lever, connecting between the first or second shell and the first locking piece; and a second release lever, connecting between the first or second shell and the second locking piece. The first or second shell may include first and second ends in the first direction, first and second ends in a second direction perpendicular to the first direction, and first and second side walls provided at the first and second ends in the first direction. The first and second release levers may be arranged with clearances from the first and second side walls and are movable toward the first and second side walls. In this aspect of the invention, the first and second locking pieces can be disengaged from the counterpart connector simply by displacing the first and second release levers toward the first and second side walls of the first or second shell.

The second release lever may include a second folded-back portion, being provided integrally with the second end in the second direction of the first or second shell and folded back toward the first end in the second direction thereof; and a second arm, being provided integrally with the second folded-back portion and is disposed with a clearance from the second side wall, the second arm including first and second ends in the second direction. The first release lever may include a first folded-back portion, being provided integrally with the second end in the second direction of the first or second shell and folded back toward the first end in the second direction thereof, a first arm, being provided integrally with the first folded-back portion and is disposed with a clearance from the first side wall; and a bridge, extending from the first arm into a space formed between the third and fourth shells. The bridge may include a first end provided integrally with the first arm and a second end disposed in the space. The second locking piece may be provided integrally with the first end of the second arm, and the first locking piece may be provided integrally with the second end of the bridge.

In this aspect of the invention, the second release lever is provided integrally with the second end in the second direction of the first or second shell, and the second locking piece is provided integrally with the first end of the second arm of the second release lever. Moreover, the first release lever is provided integrally with the second end in the second direction of the first or second shell, and the first locking piece is provided integrally with the second end of the bridge of the first release lever. Therefore, the shield case with the first and second release levers can still be fabricated with a reduced number of components. A connector including the present shield case can also be fabricated in reduced assembling man-hours.

If the body includes a slit communicating with the space between the third and fourth shells, the second end of the bridge may be disposed inside the slit, instead of being disposed in the space between the third and fourth shells.

If the body includes a locking projection, a cut-away or a locking hole for locking the locking projection may be formed in at least one of the first, second, third and fourth shells. If the body includes a locking hole, a locking projection adapted to be locked in the locking hole may be provided on at least one of the first, second, third and fourth shells. In either case, the locking projection is adapted to be locked in the locking hole, so that at least one of the first, second, third, and fourth shells is locked to the body. It is therefore easy to fix and position the body with respect to the one of the shells.

If the fourth shell includes first and second end portions in the first direction and the first and second end portions include openings, the first and second locking pieces may be adapted to face first and second ends in the first direction of the second connecting portion of the body. In this aspect of the invention, the first and second end portions of the second connecting portion are covered and shielded by the first and second locking pieces facing the first and second end portions in the first direction of the second connecting portion of the body.

A first connector of the present invention includes the above-described shield case; the body, including the main body and the first and second connecting portions projecting from the main body and lying adjacent to each other along the first direction; a plurality of first contacts, arrayed in the first and connecting portion; and a plurality of second contacts, arrayed in the second and connecting portion.

If the first connector is a plug connector, the first connector may further include a circuit board, provided in the main body of the body and connected to the first and second contacts; a cable, including a board-connectable portion adapted to be connected to the circuit board; and first and second cases having insulating properties, the first and second cases in combination being adapted to cover the first and second shells. The first and second shells of the shield case may be adapted to cover, in addition to the main body of the body, the outer circumference of the circuit board and the board-connectable portion of the cable.

A second connector of the present invention includes the above-described shield case; the body, including the main body and the first and second connecting portions projecting from the main body and lying adjacent to each other along the first direction, a plurality of first contacts, arrayed in the first and connecting portion; and a plurality of second contacts, arrayed in the second and connecting portion.

If the second connector is a plug connector, the second connector may further include a circuit board, provided in the main body of the body and adapted for connection with the first and second contacts; a cable, including a board-connectable portion adapted to be connected to the circuit board; and first and second cases having insulating properties, the first and second cases in combination being adapted to cover the first and second shells. The first and second shells of the shield case may be adapted to cover, in addition to the main body of the body, the outer circumference of the circuit board and the board-connectable portion of the cable. The first or second case may include first and second operation buttons to displace the first and second release levers toward the first and second side walls of the first or second shell.

BRIEF DESCRIPTION OF DRAWINGS

FIG. 2A is a plan view, FIG. 2B is a bottom view, and FIG. 2C is a back view.

FIG. 3A is a perspective view as seen from the front top right side, FIG. 3B is a perspective view as seen from the front top left side, and FIG. 3C is a perspective view as seen from the back bottom right side.

FIG. 4A is a perspective view as seen from the front top right side, FIG. 4B is a perspective view as seen from the back top left side, and FIG. 4C is a perspective view as seen from the back bottom right side.

DESCRIPTION OF EMBODIMENTS

Hereinafter, a plug connector according to an embodiment of the present invention will be described with referent to FIGS. 1A to 9. The plug connector shown in FIGS. 1A to 3C (hereinafter referred to as a plug P) is a connector adapted for connection with a receptacle connector (hereinafter referred to as a receptacle R) such as one shown in FIG. 9. For convenience of explanation, FIGS. 2A to 8B shows a first direction X, a second direction Y perpendicular to the first direction, and a third direction Z perpendicular to the first and second directions.

Figure 9:
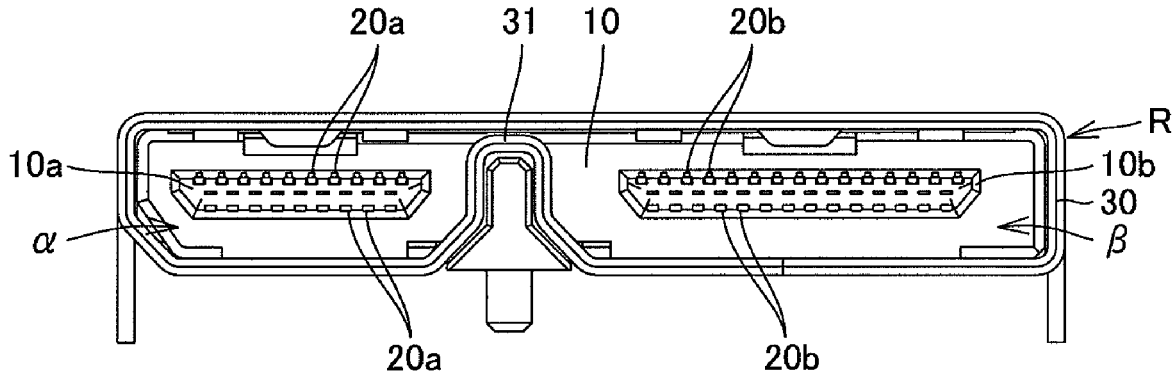
FIG. 9 is a schematic front view of a receptacle connector adapted for connection with the above-described connector.

The receptacle R includes a body 10, a plurality of contacts 20*a*, 20*b*, and a shell 30, as shown in FIG. 9. The shell 30 is a tuboid conductive metal for covering the body 10, and it has a top plate and a bottom plate. The bottom plate is bent at its center into a substantially U shape toward the top plate to form a bent portion 31. The bent portion 31 is in contact with the top plate of the shell 30. That is, the bent portion 31 partitions an internal space of the shell 30 completely into first and second slots α, β. First and second connection projections 10*a*, 10*b* project from the front surface of the body 10 into the first and second slots α, β. The contacts 20*a* are arrayed on upper and lower surfaces of the first connection projection 10*a*, and the contacts 20*b* are arrayed on upper and lower surfaces of the second connection projection 10*b*. The first slot α, the first connection projection 10*a* and the contacts 20*a* are configured to comply with the HDMI (High Definition Multimedia Interface; registered trademark) type D standard. The second slot β, the second connection projection 10*b* and the array of the contacts 20*b* are configured to comply with a standard other than HDMI standards. The second slot β have first and second locking holes (not shown) in opposite widthwise inner walls.

The plug P has a body 100, a plurality of first and second contacts 200*a*, 200*b*, a circuit board 300, first and second cables 400*a*, 400*b*, a shield case 500, and first and second resin cases 600*a*, 600*b* (first and second cases). The respective components of the plug P will be described in detail below.

Figure 4A:
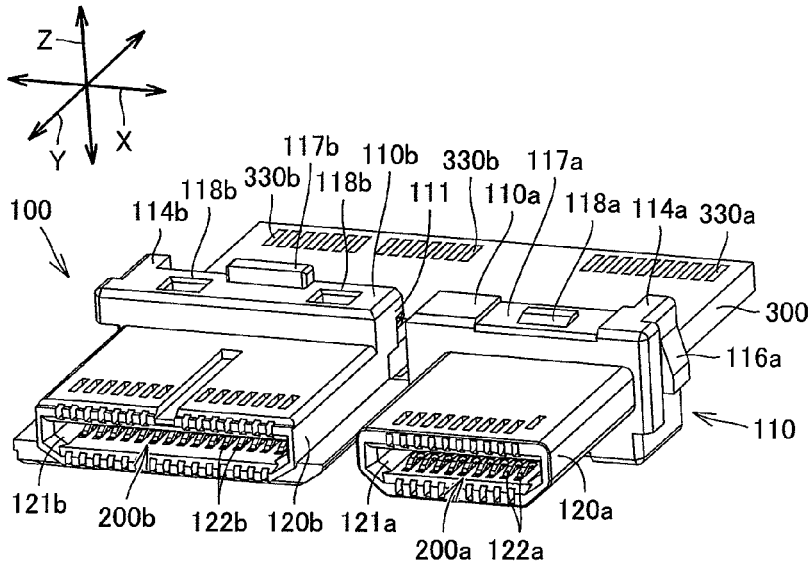
FIGS. 4A to 4C are schematic views of the body of the connector attached with the first and second contacts and the circuit board, where
Figure 4B:
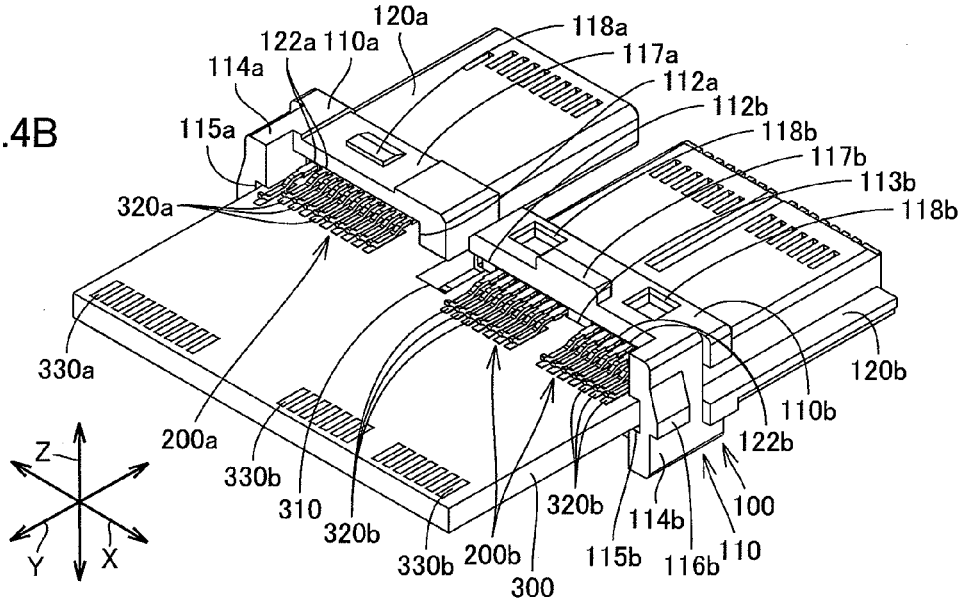
Figure 4C:
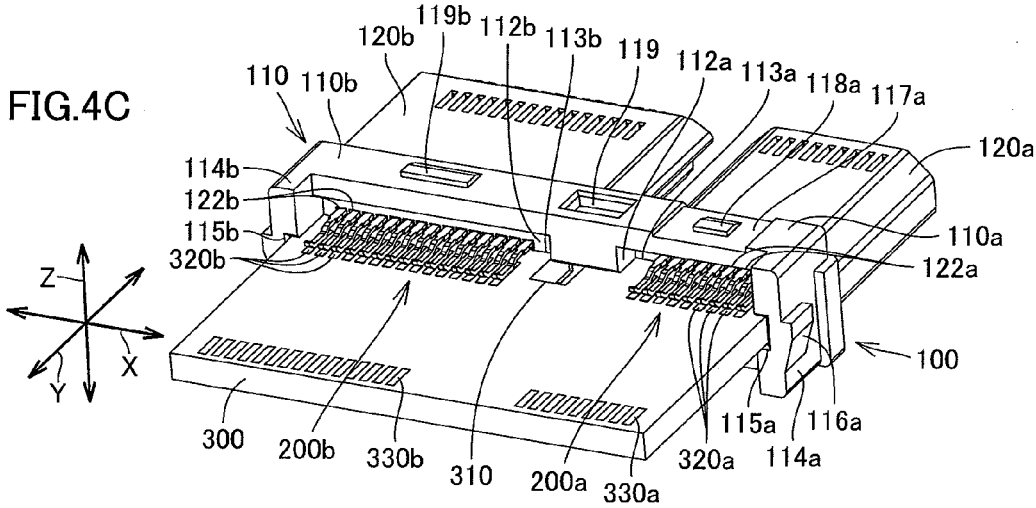

The first body 100 is an injection-molded article of insulating resin, as shown in FIGS. 4A to 4C. The body 100 has a main body 110, and first and second connecting portions 120*a*, 120*b*. The main body 110 is a substantially rectangular plate. From a front surface of the main body 110 the first and second connecting portions 120*a*, 120*b* project to lie adjacent to each other along the first direction X. The main body 110 has a slit 111 communicating with a space between the first and second connecting portions 120*a*, 120*b*. The slit 111 divides the main body 110 into first and second plates 110*a*, 110*b*.

Figure 2A:
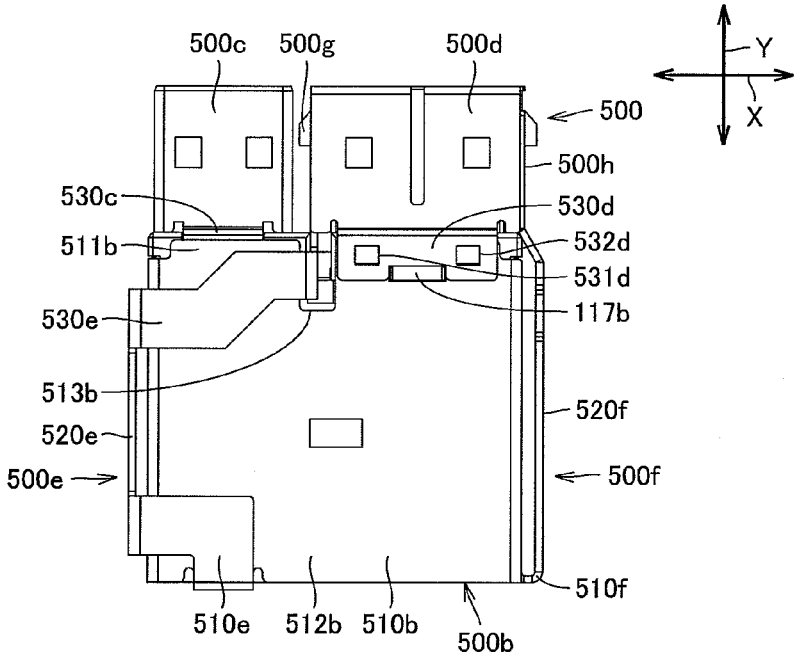
FIGS. 2A to 2C are schematic views of a body of the connector attached with a circuit board, first and second contacts, and first, second, third and fourth shells, where
Figure 2B:
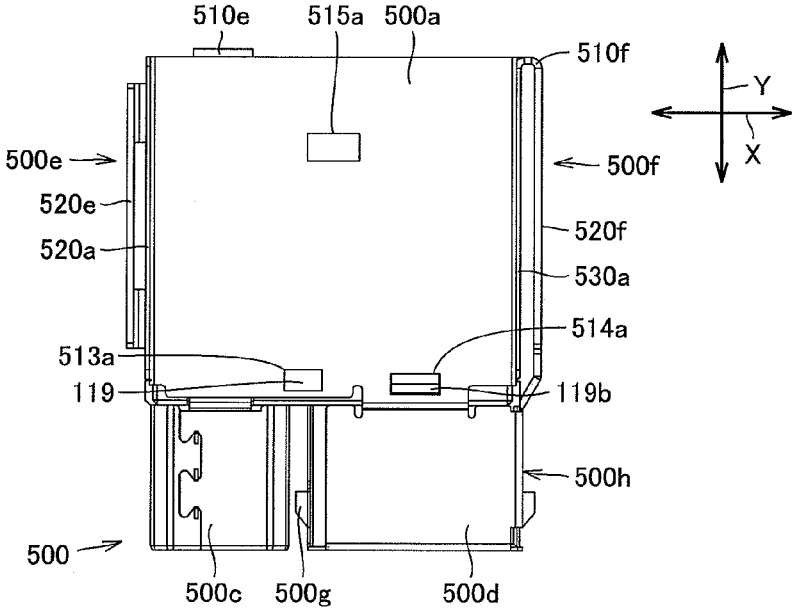
Figure 2C:
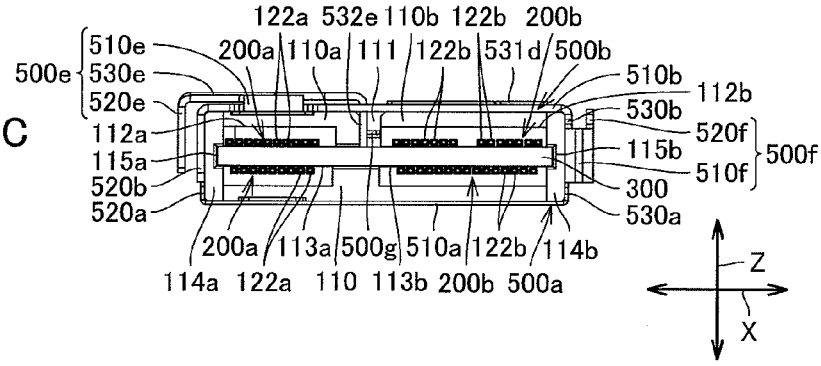

Rear surfaces of the first and second plates 110*a*, 110*b* (i.e., of the main body 110) have generally rectangular depressions 112*a*, 112*b* as shown in FIGS. 2C, 4B and 4C. On the bottom of the depressions 112*a*, 112*b*, rectangular circuit board fitting holes 113*a*, 113*b* are centrally formed to fittingly receive first ends in the second direction Y of the circuit board 300. A pair of guide plates 114*a*, 114*b* extend in the second direction Y from the respective outer ends in the first direction X of the rear surfaces of the first and second plates 110*a*, 110*b*. Inner surfaces of the guide plates 114*a*, 114*b* have a pair of guide depressions 115*a*, 115*b*. The guide depressions 115*a*, 115*b* extend in the second direction Y to guide first and second end portions in the first direction X of the circuit board 300 to the circuit board fitting holes 113*a*, 113*b*. Moreover, outer surfaces of the guide plates 114*a*, 114*b* have a pair of locking projections 116*a*, 116*b*, respectively. The locking projections 116*a*, 116*b* are tapered down (gradually reduced in thickness) toward the top.

The circuit board 300, a well-known printed circuit board, is attachable to the body 100. The circuit board 300 has the first and second end portions in the first direction X and first and second end portions in the second direction Y. The first end portion in the second direction Y of the circuit board 300 has a slit 310 at a position corresponding to the slit 111. The slit 310 communicates with the slit 111. As shown in FIGS. 4B and 4C, a plurality of electrodes 320*a*, 320*b* are arranged on upper and lower surfaces of the first end portion in the second direction Y of the circuit board 300, particularly outside the slit 310. A plurality of electrodes 330*a*, 330*b* are arranged on upper and lower surfaces of the second end portions in the second direction Y of the circuit board 300. The electrodes 320*a*, 320*b* are connected to the electrodes 330*a*, 330*b* via conductive lines (not shown) provided in at least one of the upper surface, the lower surface, and an inner portion of the circuit board 300. The electrodes 330*a*, 330*b* are connected by soldering to cores of signal lines of the first and second cables 400*a*, 400*b*, respectively. The first and second cables 400*a*, 400*b* are well-known cables, each including the plurality of signal lines, an outer shield conductor covering the signal lines, and an external insulator made of vinyl chloride or the like covering the outer shield conductor. The signal lines each include the core, an inner shield conductor covering the core, and an internal insulator covering the inner shield conductor. The first and second cables 400*a*, 400*b* are attached to a clamp 700, as shown in FIG. 10. The clamp 700 has a pair of flanges 710. It should be appreciated that FIG. 10 illustrates the first and second cables 400*a*, 400*b* with distal ends of the signal lines exposed from the external insulators of the first and second cables 400*a*, 400*b* omitted. We hereinafter use a term "board-connectable portions" referring to the distal ends of the signal lines exposed from the external insulators of the first and second cables 400*a*, 400*b*, cores of which are connectable by soldering to the electrodes 330*a*, 330*b*.

As shown in FIGS. 4A to 4C, the first plate 110*a* has a pair of attaching depressions 117*a* in its upper and lower surfaces. The bottoms of the attaching depressions 117*a* are provided with a pair of locking projections 118*a*. The second plate 110*b* has a rectangular-parallelepiped locking projection 117*b* on its upper surface. A rectangular positioning hole 118*b* is formed on either side of the projection 117*b*, as shown in FIGS. 4A and 4B. The lower surface of the second plate 110*b* is provided with a locking projection 119*b* as shown in FIG. 4C. Front ends of the locking projections 118*a* and the locking projection 119*b* are tapered (gradually reduced in thickness) toward the front. Further, a rectangular positioning hole 119 is provided between the attaching depression 117*a* and the locking projection 119*b* in a lower surface of the main body 110.

The main body 110 and the first connecting portion 120*a* have a first connection hole 121*a*, as shown in FIG. 4A. The first connection hole 121*a* passes through from a front surface of the first connecting portion 120*a* to the bottom of the circuit board fitting hole 113*a*. The first connection hole 121*a* has an inner shape conforming to an outer shape of the first connection projection 10*a* of the receptacle R. Upper and lower surfaces of the first connection hole 121*a* are provided with a plurality of receiving grooves 122*a* for receiving the contacts 200*a*, as shown in FIGS. 2C and 4A. The receiving grooves 122*a* are arrayed in a corresponding manner to the array of the contacts 20*a* of the receptacle R. Rear ends of the receiving grooves 122*a* are open from the bottom of the depression 112*a* to the outside. Rear ends of the contacts 200*a* project out of the rear ends of the receiving grooves 122*a* so as to be connected by soldering to the electrodes 320*a* of the circuit board 300, as shown in FIGS. 4B and 4C. The contacts 200*a* are bent at their front end portions, and summits of the front end portions are located inside the first connection hole 121*a*. That is, when the first connection projection 10*a* of the receptacle R is inserted into the first connection hole 121*a*, the summits of the contacts 200*a* make contact with the contacts 20*a* of the receptacle R. In summary, the first connecting portion 120*a*, the first connection hole 121*a*, the receiving grooves 122*a* and the contacts 200*a* are configured to comply with the HDMI type D standard.

The main body 110 and the second connecting portion 120*b* have a second connection hole 121*b*, as shown in FIG. 4A. The second connection hole 121*b* passes through from a front surface of the second connecting portion 120*b* to the bottom of the circuit board fitting hole 113*b*. The second connection hole 121*b* has an inner shape conforming to an outer shape of the second connection projection 10*b* of the receptacle R. Upper and lower surfaces of the second connection hole 121*b* are provided with a plurality of receiving grooves 122*b* for receiving the contacts 200*b*, as shown in FIGS. 2C and 4A. The receiving grooves 122*b* are arrayed in a corresponding manner to the array of the contacts 20*b* of the receptacle R. Rear ends of the receiving grooves 122*b* are open from the bottom surface of the depression 112*b* to the outside. Rear ends of the contacts 200*b* project out of the rear ends of the receiving grooves 122*b* so as to be connected by soldering to the electrodes 320*b* of the circuit board 300, as shown in FIGS. 4B and 4C. As shown in FIG. 4A, the contacts 200*b* are bent at their front end portions, and summits of the front end portions are located inside the second connection hole 121*b*, as shown in FIG. 4A. That is, when the second connection projection 10*b* of the receptacle R is inserted into the second connection hole 121*b*, the summits of the contacts 200*b* make contact with the contacts 20*b* of the receptacle R. In summary, the second connecting portion 120*b*, the second connection hole 121*b*, the receiving grooves 122*b*, and the contacts 200*b* are configured to comply with a standard other than HDMI standards.

The shield case 500 is configured to cover the body 100, the circuit board 300 and board-connectable portions of the first and second cables 400*a*, 400*b*, as shown in FIG. 2C. As shown in FIGS. 2A to 3C, the shield case 500 has a shell 500*a* (first shell), a shell 500*b* (second shell), a shell 500*c* (third shell), a shell 500*d* (fourth shell), release levers 500*e*, 500*f* (first and second release levers), and latch pieces 500*g*, 500*h* (first and second locking pieces).

Figure 5A:
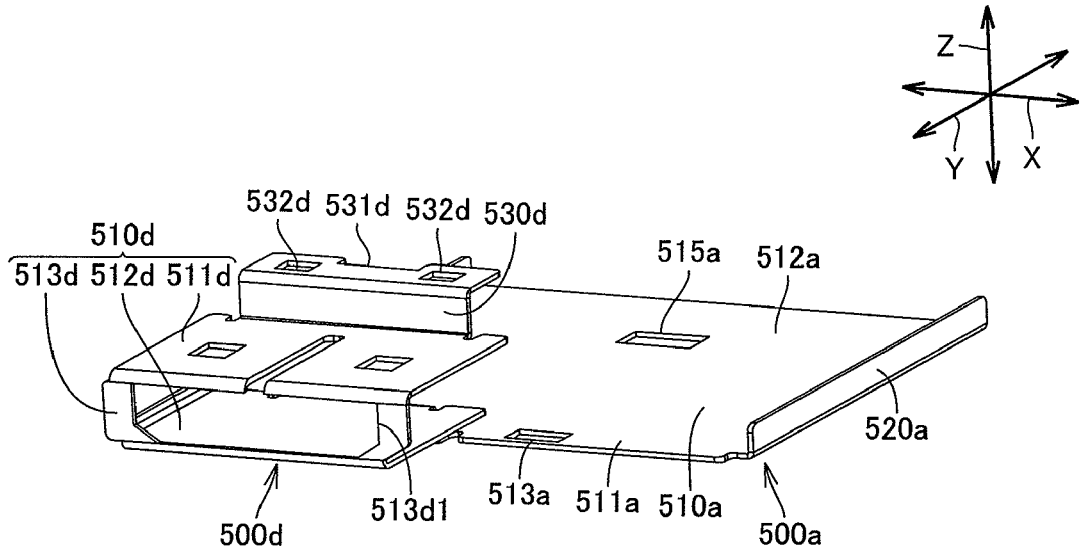
FIG. 5A is a schematic perspective view of the first and fourth shells of the connector as seen from the front top right side.
Figure 5B:
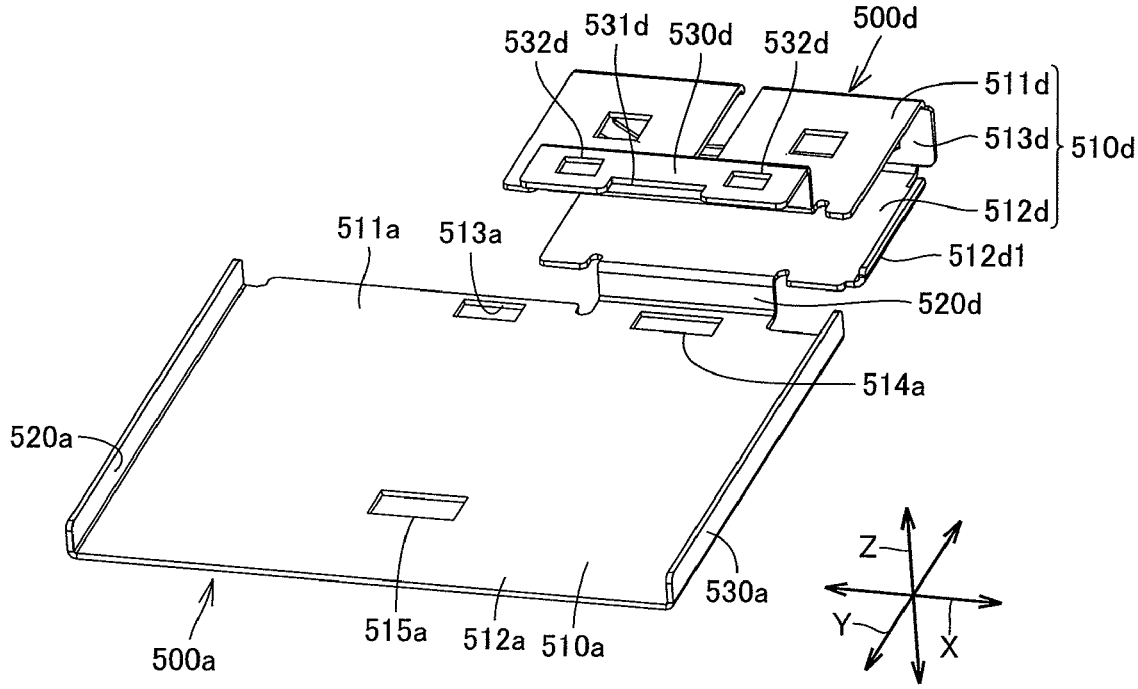
FIG. 5B is a schematic perspective view of the first and fourth shells as seen from the back top left side.

The shell 500*a* and the shell 500*d* are made of a sheet of conductive metal, as shown in FIGS. 5A and 5B. The shell 500*a* includes a rectangular base plate 510*a* (base) and rectangular side walls 520*a*, 530*a* (first and second side walls). The base plate 510*a* have first and second ends in the first direction X and first and second end portions 511*a*, 512*a* in the second direction Y. The side walls 520*a*, 530*a* stand upright at the first and second ends, respectively, in the first direction X of the base plate 510*a*. The side walls 520*a*, 530*a* abut lower portions of outer surfaces in the first direction X of the main body 110 of the body 100. The base plate 510*a* abuts the lower surface of the main body 110 of the body 100 (i.e., a first surface in the third direction Z of the main body 110). A length dimension in the second direction Y of the base plate 510*a* and the side walls 520*a*, 530*a* is larger than a length dimension from the front surface of the main body 110 to the second end in the second direction Y of the circuit board 300 as attached to the main body 110. The base plate 510*a* and the side walls 520*a*, 530*a* cover lower portions of the main body 110, the circuit board 300 and the board-connectable portion of the cable 400. As shown in FIG. 5B, the first end portion 511*a* has a positioning hole 513*a* and a locking hole 514*a*. The positioning hole 513*a*, having the same shape as the positioning hole 119, is formed at a position corresponding to the positioning hole 119 of the main body 110. The locking hole 514*a* is provided at a position corresponding to the locking projection 119*b* of the main body 110 and used to lock the locking projection 119*b*. An intermediate portion between the first and second end portions 511*a*, 512*a* of the base plate 510*a* also has a substantially rectangular positioning hole 515*a*.

Figure 3A:
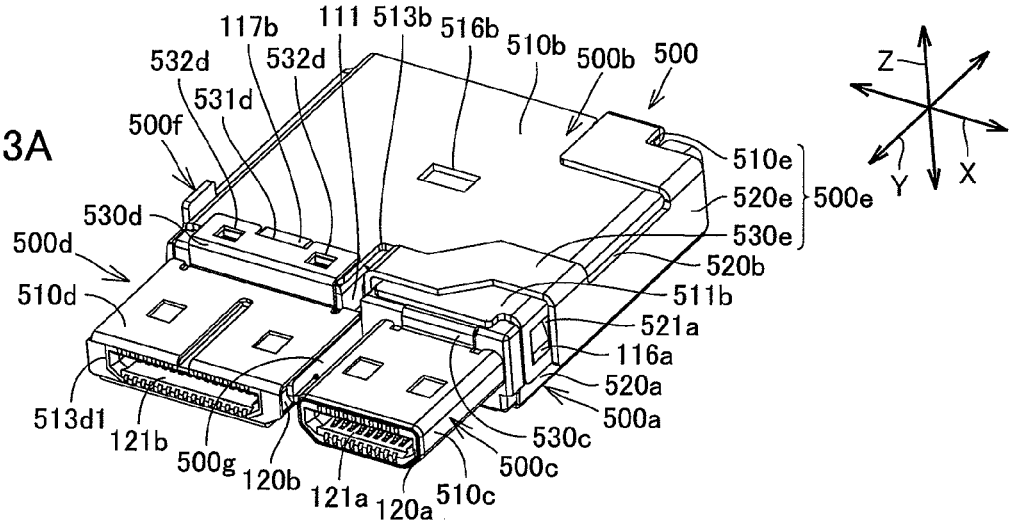
FIGS. 3A to 3C are schematic views of the body of the connector attached with the circuit board, the first and second contacts, and the first, second, third and fourth shells, where
Figure 3B:
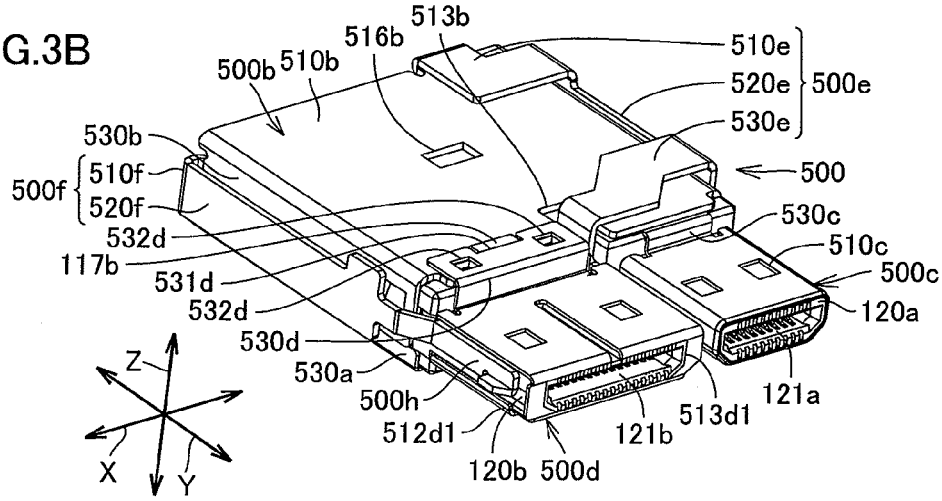

The shell 500*d* includes a shell body 510*d*, a joining plate 520*d* (joining portion) and a contact plate 530*d* (contact portion). The shell body 510*d* has an upper plate 511*d*, a lower plate 512*d*, and a front plate 513*d*. As shown in FIGS. 3A and 3B, the upper plate 511*d* is a plate of a length dimension and a width dimension slightly larger than those of an upper surface of the second connecting portion 120*b* of the body 100. The upper plate 511*d* abuts and covers the upper surface of the second connecting portion 120*b*. The lower plate 512*d* is a plate of a length dimension slightly larger than that of a lower surface of the second connecting portion 120*b* of the body 100, and of a width dimension substantially the same as that of the lower surface. The lower plate 512*d* abuts and covers the lower surface of the second connecting portion 120*b*. As shown in FIG. 5B, the lower plate 512*d* is provided with an inclined plate 512*d*1 at its outer end in the first direction X. The inclined plate 512*d*1 extend along an inclined outer surface of the second connecting portion 120*b*. Moreover, the front plate 513*d* couples the upper plate 511*d* and the lower plate 512*d* at their first ends in the second direction Y and has an outer shape slightly larger than an outer shape of the front surface of the second connecting portion 120*b*. The front plate 513*d* abuts and covers the front surface of the second connecting portion 120*b*. The front plate 513*d* has an opening 513*d*1 not to block the second connection hole 121*b* of the second connecting portion 120*b*. Moreover, clearance is created between first ends and between second ends in the first direction X of the upper plate 511*d* and the lower plate 512*d* (i.e., first and second end portions in the first direction X of the shell body 510*d* are open) so as to expose first and second ends in the first direction X of the second connecting portion 120*b*. Outer shapes of the shell body 510*d* and the second connecting portion 120*b* each conform to an inner shape of the second slot β of the receptacle R. That is, the shell body 510*d* and the second connecting portion 120*b* are adapted to fit in the second slot β.

The joining plate 520*d* is a rectangular plate to connect a second end in the second direction Y of the lower plate 512*d* and the first end portion 511*a* of the base plate 510*a*, as shown in FIG. 5B. The joining plate 520*d* makes the shell 500*d* integral with the shell 500*a*. The contact plate 530*d* is a generally downward L-shaped plate continuing to a second end in the second direction Y of the upper plate 511*d*. An upper plate of the contact plate 530*d* has a generally rectangular cut-away 531*d* at a portion corresponding to the locking projection 117*b* of the main body 110. The locking projection 117*b* is fitted and locked in the cut-away 531*d* from the back side. On either side of the cut-away 531*d* of the upper plate of the contact plate 530*d*, there is formed a positioning hole 532*d* of the same shape as that of each positioning hole 118*b* of the main body 110, at positions corresponding to the positioning holes 118*b*. The positioning holes 532*d* communicate with the positioning holes 118*b*.

Figure 6A:
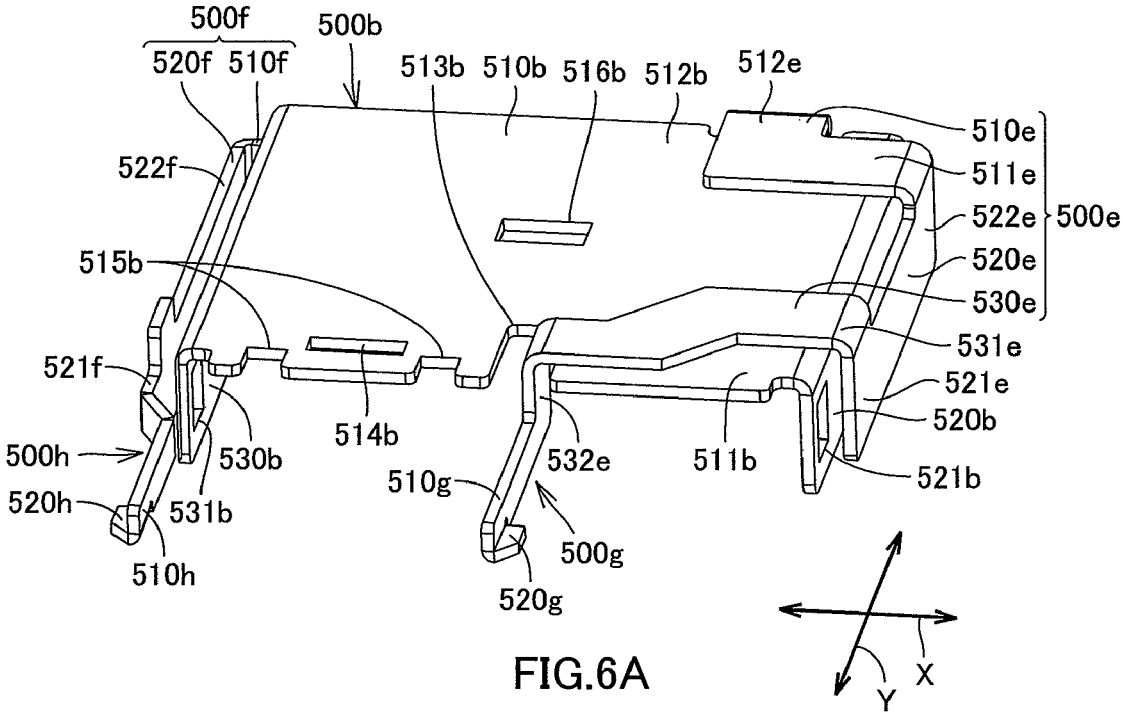
FIG. 6A is a schematic perspective view of the second shell of the connector as seen from the front top right side.
Figure 6B:
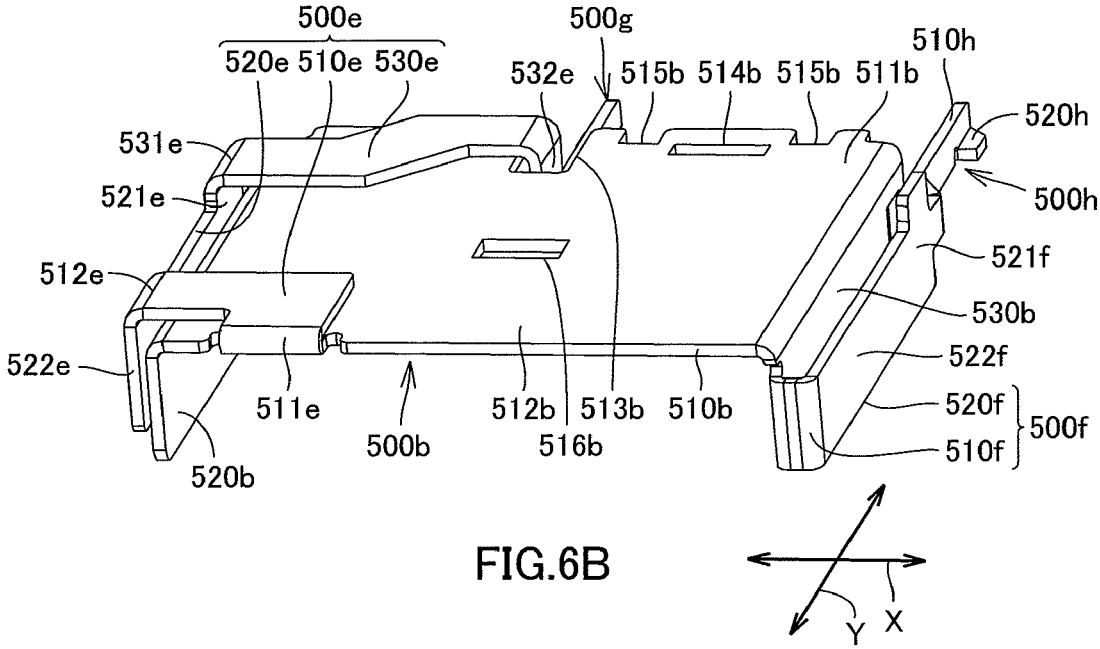
FIG. 6B is a schematic perspective view of the second shell as seen from the back top left side.

The shell 500*b*, the release levers 500*e*, 500*f* and the latch pieces 500*g*, 500*h* are made of a sheet of conductive metal, as shown in FIGS. 6A and 6B. The shell 500*b* includes a rectangular base plate 510*b* (base) and rectangular side walls 520*b*, 530*b* (first and second side walls). The base plate 510*b* have first and second ends in the first direction X and first and second end portions 511*b*, 512*b* in the second direction Y. The side walls 520*b*, 530*b* stand upright at the first and second ends, respectively, in the first direction X of the base plate 510*b*. The side walls 520*b*, 530*b* abut portions above the above-described lower portions of outer surfaces in the first direction X of the main body 110 of the body 100. The base plate 510*b* abuts the upper surface of the main body 110 of the body 100 (i.e., a second surface in the third direction Z of the main body 110). A length dimension in the second direction Y of the base plate 510*b* and the side walls 520*b*, 530*b* is larger than a length dimension from the front surface of the main body 110 to the second end in the second direction Y of the circuit board 300 as attached to the main body 110. That is, the base plate 510*b* and the side walls 520*b*, 530*b* cover upper portions excluding the above-mentioned lower portions of the main body 110, the circuit board 300 and the board-connectable portion of the cable 400.

The first end portion 511*b* has a slit 513*b* in its center, or at a position corresponding to the slit 111 of the main body 110. The slit 513*b* communicates with the slit 111 (refer to FIG. 3A). The upper plate of the contact plate 530*d* of the shell 500*d* is adapted to be placed on a portion on the left side (as shown in FIG. 6A) of the slit 513*b* of the first end portion 511*b*. In other words, the contact plate 530*d* is in contact with the left-hand portion of the first end portion 511*b* of the base plate 510*b* as shown in FIGS. 3A and 3B. This physical contact allows electrical connection between the shells 500*a*, 500*d* and the shell 500*b*. The above-described left-hand portion has a generally rectangular locking hole 514*b* at a portion corresponding to the locking projection 117*b* of the main body 110. The locking projection 117*b* is fitted and locked in the locking hole 514*b*. The left-hand portion is depressed on either side of the locking hole 514*b* to form a positioning hole 515*b*. The positioning holes 515*b* are located at positions corresponding to the positioning holes 118*b* of the body 110 and communicate with the positioning holes 532*d* of the shell 500*d* and the positioning holes 118*b*. Further, a positioning hole 516*b* is provided in the center of the base plate 510*b*. The side walls 520*b*, 530*b* each have first and second end portions in the second direction Y. The first end portions of the side walls 520*b*, 530*b* have rectangular locking holes 521*b*, 531*b* at positions corresponding to the locking projections 116*a*, 116*b* of the main body 110. The locking Projections 116*a*, 116*b* are adapted to be locked in the locking holes 521*b*, 531*b*.

The release lever 500*e* includes a folded-back portion 510*a* (first folded-back portion), an arm 520*e* (first arm) and a bridge 530*e*. The folded-back portion 510*e* has first and second end portions 511*e*, 512*e* in the second direction Y. The second end portion 512*e* is provided integrally with the second end portion 512*b* of the base plate 510*b* and folded back toward the first end portion 511*b*. The first end portion 511*e* extends from the second end portion 512*e* toward the side wall 520*b*. An end portion of the first end portion 511*e* is bent substantially at a right angle to extend along the side wall 520*b*. The arm 520*e* is a rectangular plate extending along the second direction Y and outside the side wall 520*b* with a clearance therebetween. The arm 520*e* has first and second end portions 521*e*, 522*e* in the second direction Y. The second end portion 522*e* is provided continuously to and integrally with the end portion of the first end portion 511*e* of the folded-back portion 510*e*. The bridge 530*e*, a substantially downward U-shaped plate, extends from the first end portion 521*e* of the arm 520*e* into the slit 513*b* of the base plate 510*b* and into the slit 111 of the main body 110. The bridge 530*e* has first and second end portions 531*e*, 532*e* in the first direction X. The second end portion 532*e* extends through the slit 111 into the slit 513*b*. The first end portion 531*e* is provided continuously to and integrally with the first end portion 521*e* of the arm 520*e*. The first end portion 531*e* is bent substantially at a right angle to the first end portion 521*e*. The bent portions of the first end portion 531*e* and the first end portion 511*e* are elastically deformable toward the side wall 520*b*, and such elastic deformation displaces the arm 520*e* from an initial position toward the side wall 520*b*. In accordance with the displacement of the arm 520*e*, the bridge 530*e* is displaced from an initial position in the same direction. As used herein, the "initial positions" of the arm 520*e* and the bridge 530*e* refer to a state where the arm 520*e* is substantially parallel to the side wall 520*b*.

The latch piece 500*g* includes an arm 510*g* extending in the second direction Y and a claw 520*g* provided at a distal end of the arm 510*g*. The arm 510*g* is provided continuously to and integrally with the second end portion 532*e* of the bridge 530*e*. The arm 510*g* is oriented to face the first end portion in the first direction X of the second connecting portion 120*b* with a clearance therebetween so as to cover this first end portion. The claw 520*g* is adapted to be locked in a first locking hole of the receptacle R. In accordance with the displacement of the arm 520*e* and the bridge 530*e*, the arm 510*g* and the claw 520*g* are displaced from initial positions toward the first end portion of the second connecting portion 120*b*, so that the claw 520*g* gets disengaged from the first locking hole of the receptacle R. As used herein, the "initial positions" of the arm 510*g* and the claw 520*g* refer to a state where the arm 520*e* is substantially parallel to the side wall 520*b*.

The release lever 500*f* includes a folded-back portion 510*f* (second folded-back portion) and an arm 520*f* (second arm). The folded-back portion 510*f* is provided integrally with the second end portion in the second direction Y of the side wall 530*b*, and it is folded back toward the first end portion in the second direction Y of the side wall 530*b*. The arm 520*f* is a rectangular plate extending in the second direction Y and lies outside the side wall 530*b* with a clearance therebetween. The arm 520*f* has first and second end portions 521*f*, 522*f* in the second direction Y. The second end portion 522*f* is provided continuously to and integrally with the folded-back portion 510*f*. The folded-back portion 510*f* is elastically deformable toward the side wall 530*b*, and such elastic deformation displaces the arm 520*f* from an initial position toward the side wall 530*b*. As used herein, the "initial position" of the arm 520*f* refers to a state where the arm 520*f* is substantially parallel to the side wall 530*b*.

The latch piece 500*h* includes an arm 510*h* extending in the second direction Y and a claw 520*h* provided at a distal end of the arm 510*h*. The arm 510*h* is provided continuously to and integrally with the first end portion 521*f* of the arm 520*f*. The arm 510*h* is oriented to face with a clearance the second end portion in the first direction X of the second connecting portion 120*b* so as to cover this second end portion. The claw 520*h* is adapted to be locked in a second locking hole of the receptacle R. In accordance with the displacement of the arm 520*f* of the release lever 500*f*, the arm 510*h* and the claw 520*h* are displaced from initial positions toward the second end portion of the second connecting portion 120*b*, so that the claw 520*h* gets disengaged from the second locking hole of the receptacle R. As used herein, the "initial positions" of the arm 510*h* and the claw 520*h* refer to a state where the arm 520*f* is substantially parallel to the side wall 530*b*.

Figure 3C:
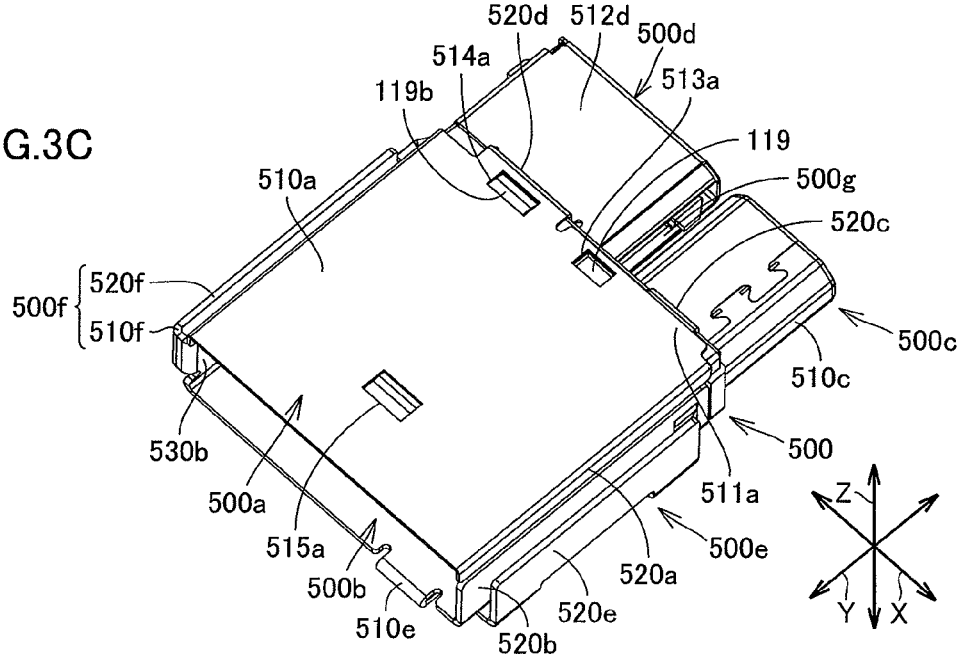
Figure 7A:
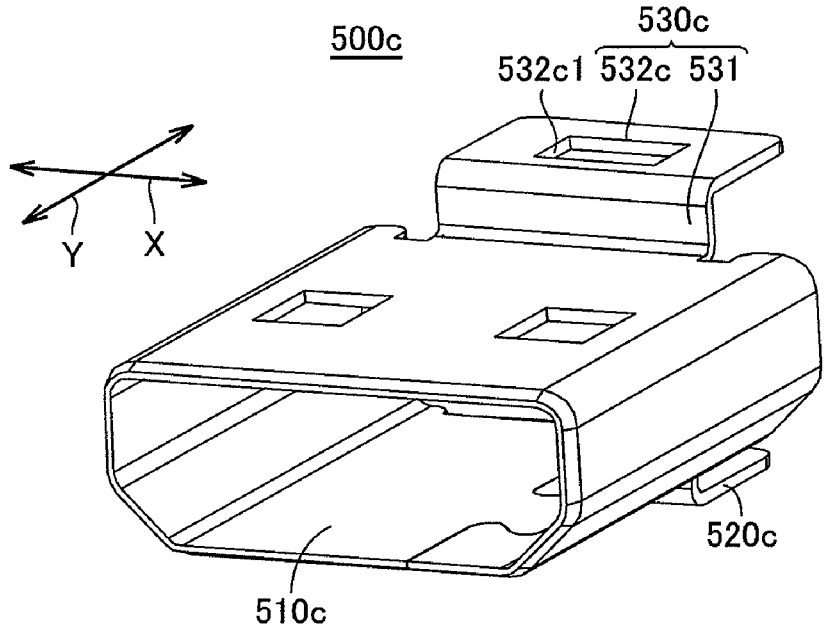
FIG. 7A is a schematic perspective view of the third shell of the connector as seen from the front top right side.
Figure 7B:
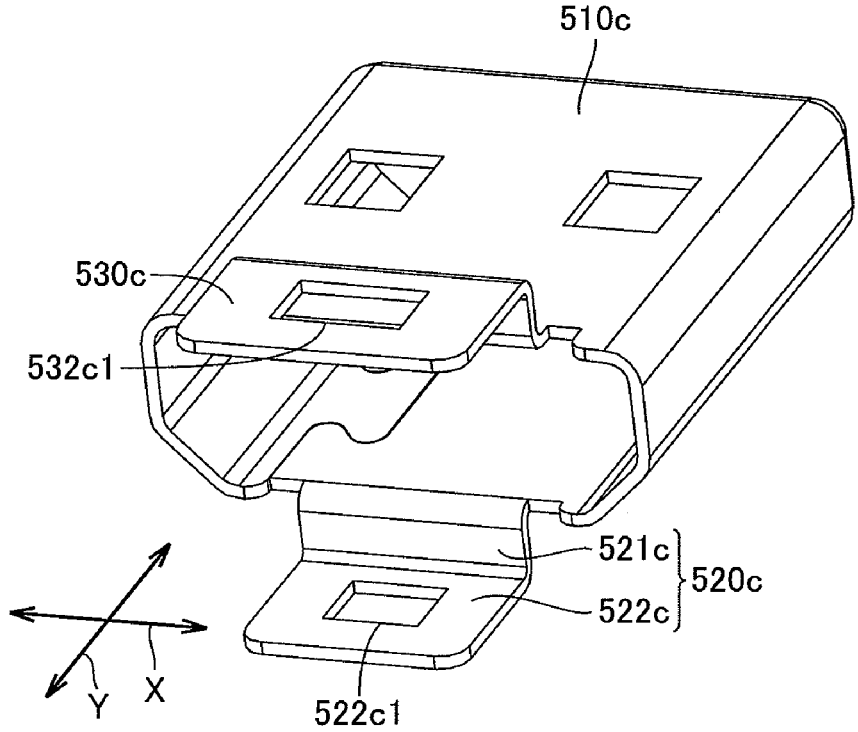
FIG. 7B is a schematic perspective view of the third shell as seen from the back top left side.

The shell 500*c* is made of a sheet of conductive metal. The shell 500*c* includes a shell body 510*c* and first and second contact plates 520*c*, 530*c*, as shown in FIGS. 7A and 7B. The shell body 510*c* is a tuboid body to cover the outer circumference of the first connecting portion 120*a*. The shell body 510*c* and the first connecting portion 120*a* have outer shapes conforming to an inner shape of the first slot α and are adapted to fit in the second slot α. The first contact plate 520*c* is a substantially L-shaped plate provided continuously to a lower plate of the shell body 510*c* as shown in FIG. 7B, and the second contact plate 530*c* is a substantially L-shaped plate provided continuously to an upper plate of the shell body 510*c* as shown in FIG. 7A. The first and second contact plates 520*c*, 530*c* include first plates 521*c*, 531*c*, respectively, and second plates 522*c*, 532*c*, respectively, extending substantially at a right angle to the first plates 521*c*, 531*c*. The second plates 522*c*, 532*c* are adapted to fit in the attaching depressions 117*a* in the upper and lower surfaces, respectively, of the main body 110. The second plates 522*c*, 532*c* have rectangular locking holes 522*c*1, 532*c*1 at positions corresponding to the locking projections 118*a* on the bottom of the attaching depressions 117*a*. The locking projections 118*a* are fitted and locked in the associated locking holes 522*c*1, 532*c*1. The second plate 522*c* is in contact with the first end portion 511*a* of the base plate 510*a* of the shell 500*a*, as shown in FIG. 3C. The second plate 532*c* is in contact with a portion on the right side (as shown in FIGS. 3A and 3B) of the slit 513*b* of the first end portion 511*b* of the base plate 510*b* of the shell 500*b*. These physical contacts allow electrical connection between the shells 500*a* to 500*d*.

Figure 8A:
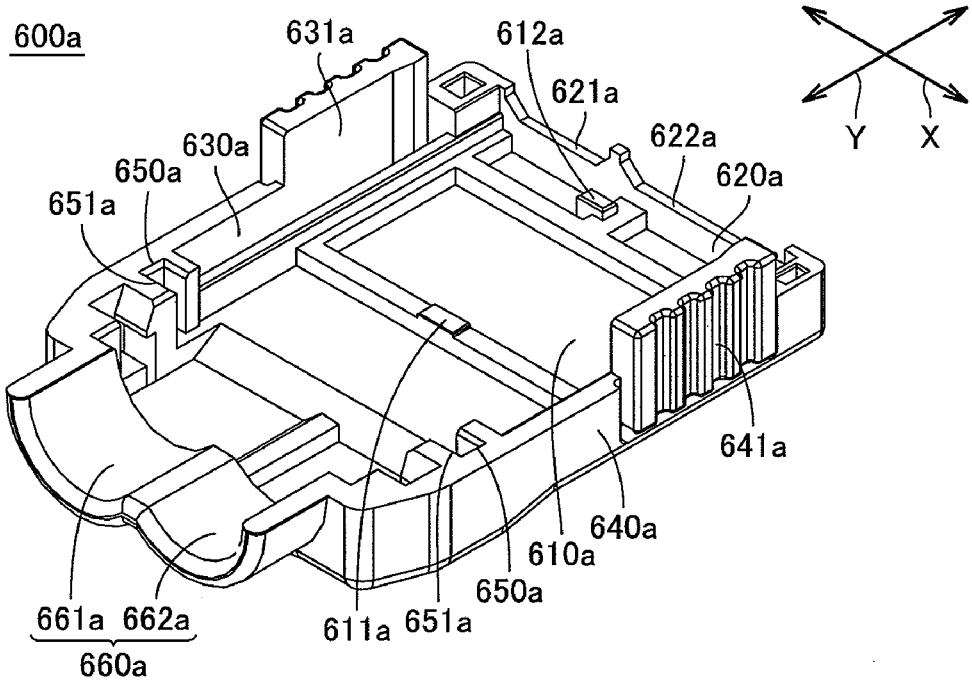
FIG. 8A is a schematic perspective view of a first resin case of the connector as seen from the back top left side.

The first resin case 600*a* is an injection-molded article of insulating resin as shown in FIG. 8A. The first resin case 600*a* includes a bottom plate 610*a*, a front wall 620*a*, outer walls 630*a*, 640*a*, a pair of fixing portions 650*a*, and a lead-out portion 660*a*. In the bottom plate 610*a*, its first end portion in the second direction Y is provided with the front wall 620*a* standing upright, while its second end portion in the second direction Y is provided with the lead-out portion 660*a*. First and second end portions in the first direction X of the bottom plate 610*a* are provided with the outer walls 630*a*, 640*a*, respectively. Inside the outer walls 630*a*, 640*a* of the bottom plate 610*a*, there is provided the pair of fixing portions 650*a*. A space surrounded by the front wall 620*a*, the outer walls 630*a*, 640*a*, and the fixing portions 650*a* on the bottom plate 610*a* is used as an accommodating space to receive lower portions of the main body 110 of the body 100, the circuit board 300, and shells 500*a*, 500*b* and the release levers 500*e*, 500*f* of the shield case 500. An elongated protrusion extends along the first direction X in a central portion of the bottom plate 610*a*, and a substantially rectangular positioning projection 611*a* is provided centrally of the elongated protrusion. The positioning projection 611*a* is fittable into the positioning hole 515*a* of the shell 500*a* of the shield case 500 so as to position and fix the shield case 500 in the accommodating space. Another positioning projection 612*a* is provided near the front wall 620*a* of the bottom plate 610*a*. The positioning projection 612*a* is fittable into the positioning hole 513*a* of the shell 500*a* and the positioning hole 119 of the main body 110 so as to position and fix the shield case 500 in the accommodating space.

The front wall 620*a* has first and second depressions 621*a*, 622*a* adjacent to each other along the first direction X. The outer walls 630*a*, 640*a* are provided with operation buttons 631*a*, 641*a*, respectively (first and second operation buttons) at such positions as to face the arms 520*e*, 520*f*, respectively of the release levers 500*e*, 500*f* of the shield case 500, as shown in FIG. 10. When the operation buttons 631*a*, 641*a* press the arms 520*e*, 520*f*, the arms 520*e*, 520*f* are displaced inward (i.e., toward the walls 520*b*, 530*b*). The fixing portions 650*a* each have a slit 651*a*. The slits 651*a* are adapted to receive and position lower portions of the flanges 710 of the clamp 700. The lead-out portion 660*a* is configured to include two substantially semicircular arc-shaped depressions 661*a*, 662*a* in a continuous arrangement along the first direction X.

Figure 8B:
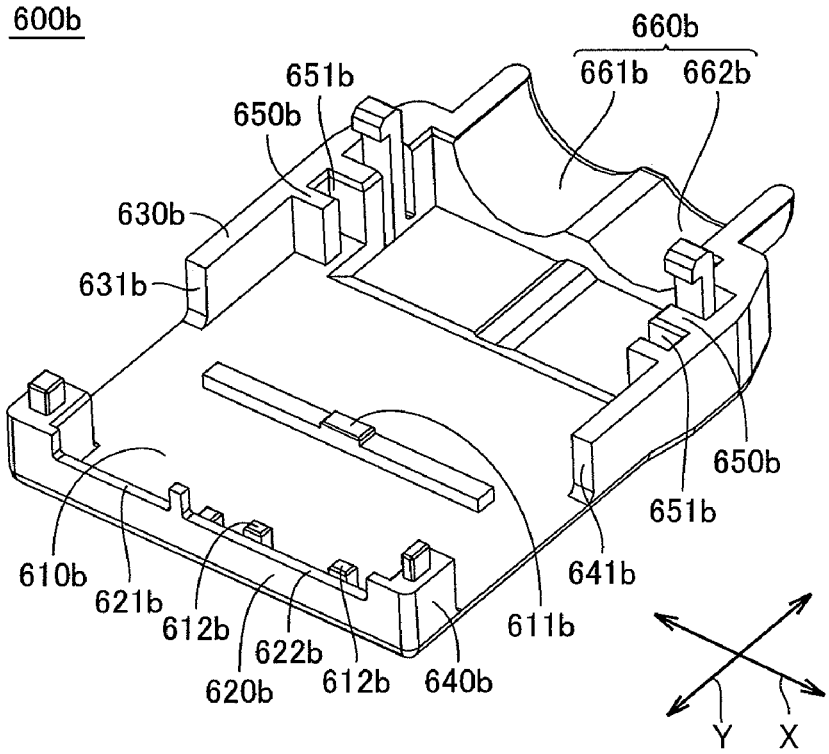
FIG. 8B is a schematic perspective view of the second resin case of the connector as seen from the front bottom right side.

The second resin case 600*b* made of insulating resin is an upper case to be combined with the first resin case 600*a*, as shown in FIG. 8B. The second resin case 600*b* has a bottom plate 610*b*, a front wall 620*b*, outer walls 630*b*, 640*b*, a pair of fixing portions 650*b*, and a lead-out portion 660*b*. In the bottom plate 610*b*, its first end portion in the second direction Y is provided with the front wall 620*b* standing upright, while its second end portion in the second direction Y is provided with the lead-out portion 660*b*. First and second end portions in the first direction X of the bottom plate 610*b* are provided with the outer walls 630*b*, 640*b*. Inside the outer walls 630*b*, 640*b* of the bottom plate 610*b*, there is provided the pair of fixing portions 650*b*. A space surrounded by the front wall 620*b*, the outer walls 630*b*, 640*b*, and the fixing portions 650*b* on the bottom plate 610*b* is used as an accommodating space to receive upper portions of the main body 110 of the body 100, the circuit board 300, and shells 500*a*, 500*b* and the release levers 500*e*, 500*f* of the shield case 500. That is, the first and second resin cases 600*a*, 600*b* cover the main body 110, the circuit board 300, the shells 500*a*, 500*b*, and the release levers 500*e*, 500*f*. An elongated protrusion extends along the first direction X in a central portion of the bottom plate 610*b*, and a substantially rectangular positioning projection 611*b* is provided centrally of the elongated protrusion. The positioning projection 611*b* is fittable into the positioning hole 516*b* of the shell 500*b* of the shield case 500 so as to position and fix the shield case 500 in the accommodating space. A pair of rectangular column-shaped positioning projections 612*b* corresponding to the positioning holes 532*d* of the shield case 500 is provided near the front wall 620*b* of the bottom plate 610*b*, i.e., at positions corresponding to the positioning holes 532*d*. The positioning projections 612*b* are fittable into the pair of positioning holes 532*d* of the shell 500*d*, the positioning holes 515*b* of the shell 500*b*, and the positioning holes 118*b* of the main body 110 so as to position and fix the shield case 500 and the body 100 in the accommodating space.

Figure 1C:
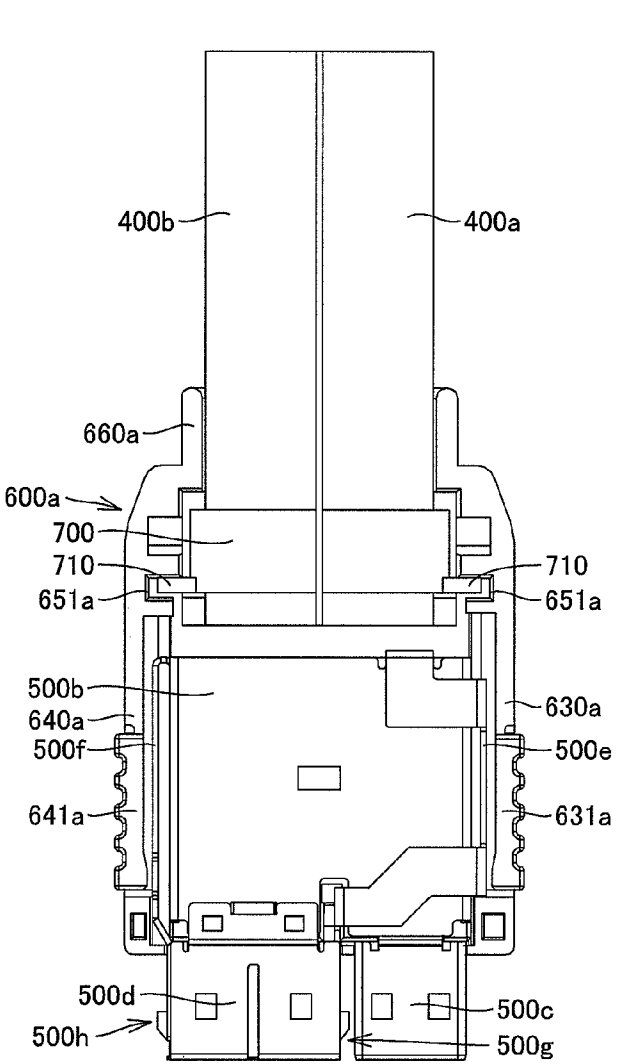
FIG. 1C is a schematic plan view of the connector with its second resin case removed.
Figure 1A:
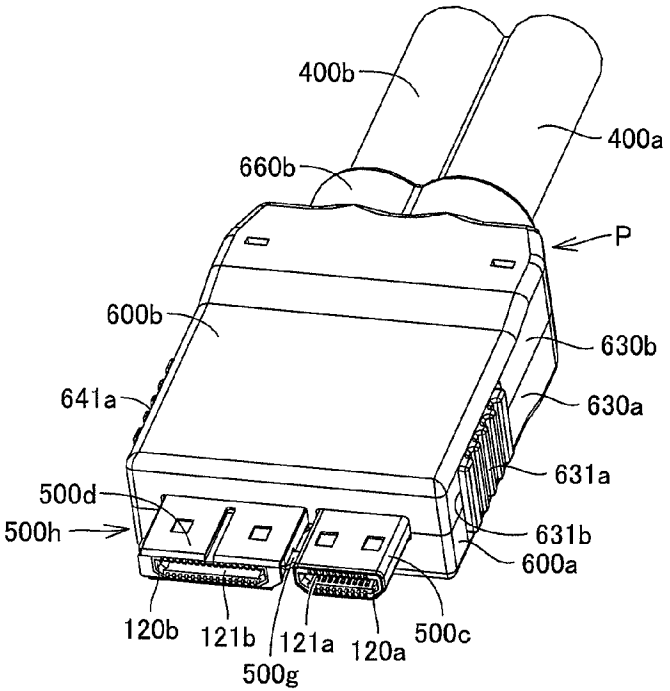
FIG. 1A is a schematic perspective view of a connector according to an embodiment of the present invention as seen from the front top right side.
Figure 1B:
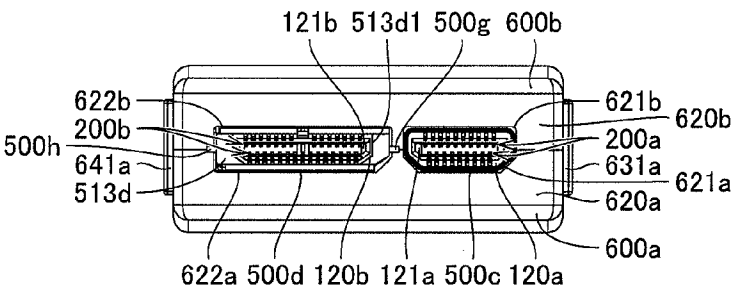
FIG. 1B is a schematic front view of the connector.

The front wall 620*b* have first and second depressions 621*b*, 622*b* adjacent to each other along the first direction X. As shown in FIG. 1B, the first depression 621*b* is to be combined with the first depression 621*a* of the first resin case 600*a* to provide an opening to allow the first connecting portion 120*a* and the shell 500*c* covering the same to project therethrough to the outside. Similarly, the second depression 622*b* is to be combined with the second depression 622*a* of the first resin case 600*a* to provide an opening to allow the second connecting portion 120*b* and the shell 500*d* covering the same to project therethrough to the outside. The outer walls 630*b*, 640*b*, have loading depressions 631*b*, 641*b* for loading the operation buttons 631*a*, 641*a* at positions corresponding to the operation buttons 631*a*, 641*a*. The fixing portions 650*b* each have a slit 651*b*. The slits 651*b* are adapted to receive and position upper portions of the flanges 710 of the clamp 700. The lead-out portion 660*b* is configured to include two substantially semicircular arc-shaped depressions 661*b*, 662*b* in a continuous arrangement along the first direction X. The depression 661*b* is to be combined with the depression 661*a* of the first resin case 600*a* to provide a lead-out hole to lead out the first cable 400*a*. Similarly, the depression 662*b* is to be combined with the depression 662*a* of the first resin case 600*a* to provide a lead-out hole to lead out the second cable 400*b*.

The plug P having the above-described structure may be assembled in the steps as described below. The assembly steps include the steps to attach the shield case 500 to the body 100. The first step is to prepare the body 100. The contacts 200*a*, 200*b* are then inserted into the receiving grooves 122*a*, 122*b* of the body 100 from the rear side. Thereafter, the circuit board 300 is prepared with the electrodes 320*a*, 320*b*, 330*a*, 330*b* formed thereon. The circuit board 300 is inserted into the guide depressions 115*a*, 115*b* of the body 100. Using the guide depressions 115*a*, 115*b* to guide the first and second end portions in the first direction X of the circuit board 300, the circuit board 300 is further moved toward the main body 110 of the body 100, and the first end portion in the second direction Y of the circuit board 300 is fitted in the circuit board fitting holes 113*a*, 113*b* of the main body 110. Consequently, the rear end portions of the contacts 200*a* come into contact with the electrodes 320*a* of the circuit board 300 and the rear end portions of the contacts 200*b* come into contact with the electrodes 320*b* of the circuit board 300. The rear end portions of the contacts 200*a* are then soldered to the electrodes 320*a* of the circuit board 300, and the rear end portions of the contacts 200*b* are soldered to the electrodes 320*b* of the circuit board 300. The next step is to prepare the first and second cables 400*a*, 400*b*, in which the external insulators are striped to expose distal ends of the plurality of signal lines. The cores of the signal lines are connected by soldering to the electrodes 330*a*, 330*b* of the circuit board 300. This is how the contacts 200*a*, 200*b*, the circuit board 300, and the first and second cables 400*a*, 400*b* are attached to the body 100.

The next step is to prepare the shell 500*c* formed by press-molding a metal sheet. The first connecting portion 120*a* of the body 100 is inserted into the shell body 510*c* of the shell 500*c*. The second plates 522*c*, 532*c* of the first and second contact plates 520*c*, 530*c* of the shell 500*c* are fitted in the upper and lower attaching depressions 117*a*, respectively, of the main body 110 of the body 100, and the locking projections 118*a* on the bottom of the attaching depressions 117*a* are fitted and locked in the locking holes 522*c*1, 532*c*1 of the second plates 522*c*, 532*c*. The shell 500*c* is now attached to the body 100 and cover an outer circumference of the first connecting portion 120*a*.

The next step is to prepare the shell 500*b*, the release levers 500*e*, 500*f*, and the latch pieces 500*g*, 500*h* formed by press-molding a metal sheet. The shell 500*b* is placed over the main body 110 of the body 100 from above, so that the side walls 520*b*, 530*b* of the shell 500*b* abut the upper portions of the opposite surfaces in the first direction X of the main body 110. Simultaneously, the locking projections 116*a*, 116*b* of the main body 110 are fitted and locked in the locking holes 521*b*, 531*b* of the side walls 520*b*, 530*b*. Also, the base plate 510*b* of the shell 500*b* abuts and contacts the upper surface of the main body 110, so that the portion on the right side of the slit 513*b* of the first end portion 511*b* of the base plate 510*b* is placed on the second plate 532*c* of the second contact plate 530*c* of the shell 500*c*. This physical contact allows electrical connection between the shell 500*b* and the shell 500*c*. Simultaneously, the locking projection 117*b* of the main body 110 is fitted and locked in the locking hole 514*b* of the base plate 510*b* of the shell 500*b*. The positioning holes 515*b* in the portion on the left side of the slit 513*b* in the first end portion 511*b* of the shell 500*b* are disposed so as to communicate with the positioning holes 118*b* of the main body 110. Furthermore, the latch piece 500*g* is disposed to face with the clearance the first end portion in the first direction X of the second connecting portion 120*b*, and the latch piece 500*h* is disposed to face with the clearance the second end portion in the first direction X of the second connecting portion 120*b*.

The next step is to prepare the shells 500*a*, 500*d* formed by press-molding a metal sheet. The second connecting portion 120*b* of the body 100 is inserted into the shell body 510*d* of the shell 500*d*, and the upper plate of the contact plate 530*d* of the shell 500*d* is placed on and brought into contact with the left portion of the shell 500*b*. This physical contact allows electrical connection between the shells 500*d*, 500*a* and the shell 500*b*. Simultaneously, the locking projection 117*b* of the main body 110 is fitted and locked in the cut-away 531*d* of the upper plate of the contact plate 530*d*, and the positioning holes 532*d* of the upper plate of the contact plate 530*d* are disposed so as to communicate with the positioning holes 515*b* of the shell 500*b* and with the positioning holes 118*b* of the main body 110. It should be noted that the first and second end portions in the first direction X of the shell body 510*d* are open. The shell body 510*d* of such configuration can receive the second connecting portion 120*b* without interfering with latch pieces 500*g*, 500*h* provided near the first and second ends in the first direction X of the second connecting portion 120*b*. Through the attachment of the shell 500*d* to the second connecting portion 120*b* as described above, the base plate 510*a* of the shell 500*a* is brought into abutment with the lower surface of the main body 110 of the body 100, and the side walls 520*a*, 530*a* of the shell 500*a* abut the lower portions of the opposite surfaces in the first direction X of the main body 110. The first end portion 511*a* of the base plate 510*a* of the shell 500*a* is placed on and brought into abutment with the second plate 522*c* of the first contact plate 520*c*. Consequently, the base plate 510*a* and the side walls 520*a*, 530*a* of the shell 500*a*, and the base plate 510*b* and the side walls 520*b*, 530*b* of the shell 500*b* cover the outer circumference of the main body 110, the circuit board 300, and the board-connectable portion of the cable 400. Moreover, the positioning hole 513*a* of the shell 500*a* communicates with the positioning hole 119 of the main body 110. The locking projection 119*b* of the main body 110 is fittingly received and locked in the locking hole 514*a* of the shell 500*a*.

The next step is to prepare the first and second resin cases 600*a*, 600*b*. The shells 500*a*, 500*b*, the main body 110 of the body 100, and the circuit board 300 are placed into the accommodating space of the first resin case 600*a*. The shell body 510*c* of the shell 500*c* and the first connecting portion 120*a* of the body 100 are inserted into the first depression 621*a* of the front wall 620*a* of the first resin case 600*a*, and the shell body 510*d* of the shell 500*d* and the second connecting portion 120*b* of the body 100 are inserted into the second depression 622*a* of the front wall 620*a*. Simultaneously, the flanges 710 of the clamp 700 attached to the first and second cables 400*a*, 400*b* are fitted in the slits 651*a* of the fixing portions 650*a* of the first resin case 600*a*, and the first and second cables 400*a*, 400*b* are inserted into the depressions 661*a*, 662*a* of the lead-out portion 660*a* of the first resin case 600*a*. The positioning projection 611*a* of the first resin case 600*a* is fitted in the positioning hole 515*a* of the shell 500*a* of the shield case 500, and the positioning projection 612*a* is fitted in the positioning hole 513*a* of the shell 500*a* and the positioning hole 119 of the main body 110. Thereafter, the second resin case 600*b* is attached to the first resin case 600*a*, so that the operation buttons 631*a*, 641*a* of the first resin case 600*a* are inserted into the loading depressions 631*b*, 641*b* of the second resin case 600*b*. Also, the shells 500*a*, 500*b*, the main body 110 of the body 100, and the circuit board 300 are accommodated in the accommodating space of the second resin case 600*b*. The shell body 510*c* of the shell 500*c* and the first connecting portion 120*a* of the body 100 are inserted into the first depression 621*b* of the front wall 620*b* of the second resin case 600*b*, and the shell body 510*d* of the shell 500*d* and the second connecting portion 120*b* of the body 100 are inserted into the second depression 622*b* of the front wall 620*b*. Moreover, the flanges 710 of the clamp 700 is fitted in the slits 651*b* of the fixing portions 650*b* of the second resin case 600*b*. The first and second cables 400*a*, 400*b* are inserted into the depressions 661*b*, 662*b* of the lead-out portion 660*b* of the second resin case 600*b*. Moreover, the positioning projection 611*b* of the second resin case 600*b* is fitted in the positioning hole 516*b* of the shell 500*b*, and the pair of positioning projections 612*b* is fitted in the pair of positioning holes 532*d* of the shell 500*d*, the positioning holes 515*b* of the shell 500*b*, and the positioning holes 118*b* of the main body 110. The first and second resin cases 600*a*, 600*b* now accommodate the shells 500*a*, 500*b*, the main body 110 of the body 100, the circuit board 300, and the board-connectable portions of the first and second cables 400*a*, 400*b*.

The plug P assembled in the above-described steps may be connected to the receptacle R in the following steps. First, the first connecting portion 120*a* and the shell body 510*c* of the shell 500*c* of the plug P are inserted into the first slot α of the receptacle R, and the second connecting portion 120*b* and the shell body 510*d* of the shell 500*d* are inserted into the second slot β of the receptacle R. Upon the insertion, the inner walls of the second slot β press the claws 520*g*, 520*h* of the latch pieces 500*g*, 500*h*, so that the latch pieces 500*g*, 500*h* are displaced from the initial positions to the inner sides (i.e., toward the first and second ends in the first direction X of the second connecting portion 120*b*). Consequently, the bent portions of the first end portion 531*e* and the first end portion 511*e* of the release lever 500*e* are elastically deformed, so that the bridge 530*e* and the arm 520*e* of the release lever 500*e* are deformed inward from the initial positions. Simultaneously, the folded-back portion 510*f* of the release lever 500*f* is elastically deformed, so that the arm 520*f* of the release lever 500*f* is displaced inward from the initial position. Once the claws 520*g*, 520*h* of the latch pieces 500*g*, 500*h* are fitted in the first and second locking holes of the second slot β, elastic forces of the bent portions of the first end portion 531*e* and the first end portion 511*e* of the release lever 500*e* move the bridge 530*e*, the arm 520*e*, and the latch piece 500*g* back to their initial positions. Similarly, elastic force of the folded-back portion 510*f* of the release lever 500*f* moves the arm 520*f* and the latch piece 500*h* back to their initial positions. The claws 520*g*, 520*h* are now fitted in the first and second locking holes of the second slot β, maintained in a locked state in the first and second locking holes of the second slot β (fully-latched state).

Simultaneously, the first connection projection 10*a* of the receptacle R is inserted into the first connection hole 121*a* of the first connecting portion 120*a*, and the contacts 20*a* of the receptacle R come into contact with the summits of the contacts 200*a*. Similarly, the second connection projection 10*b* of the receptacle R is inserted into the second connection hole 121*b* of the second connecting portion 120*b*, and the contacts 20*b* of the receptacle R come into contact with the summits of the contacts 200*b*. This is how to connect the plug P to the receptacle R. It should be appreciated that the shell bodies 510*c*, 510*d* of the shells 500*c*, 500*d* come into contact with the shell 30 of the receptacle R and are thereby connected through the shell 30 to a ground line of the circuit board on which the receptacle R is mounted.

The connected plug P may be detached from the receptacle R in the following steps. First, the operation buttons 631*a*, 641*a* of the plug P are pressed. The pressed operation button 631*a* presses the arm 520*e* of the release lever 500*e* at the initial position inward, and the pressed operation button 641*a* presses the arm 520*f* of the release lever 500*f* at the initial position inward. Then, the bent portions of the first end portion 531*e* and the first end portion 511*e* of the release lever 500*e* are elastically deformed, and the folded-back portion 510*f* of the release lever 500*f* is elastically deformed. Simultaneously, the latch pieces 500*g*, 500*h* are displaced inward from the initial positions. Consequently, the claws 520*g*, 520*h* come off and get disengaged from the first and second locking holes of the second slot β. The plug P is now ready to be pulled out of the receptacle R.

In the plug P as described above, the shell 500*a* and the shell 500*d* are made of a single metal sheet, and the shell 500*b*, the release levers 500*e*, 500*f*, and the latch pieces 500*g*,

500*h* are made of a single metal sheet. The plug P is therefore advantageous in reducing the number of components and assembling man-hours. The decreased number of shells also means reduced costs for press work of the shells, and the plug P can be further reduced in cost in this regard. Moreover, as the fourth shell 500*d* is integrated with the first shell 500*a*, electrical connection between the shells 500*a* to 500*d* can be established with ease, simply by bringing the contact plate 530*d* of the shell 500*d* into contact with the first end portion 511*b* of the shell 500*b*, bringing the first contact plate 520*c* of the shell 500*c* into contact with the first end portion 511*a* of the shell 500*a*, and bringing the second contact plate 530*c* of the shell 500*c* into contact with the first end portion 511*b* of the shell 500*b*. Further advantageously, the shell 500*c* and the shell 500*d* independently cover the first connecting portion 120*a* and the first connecting portion 120*b*, respectively. As such, the plug P can be connected to a receptacle connecter such as the receptacle R with the first and second slots α, β fully partitioned with the bent portion 31. Furthermore, as the shell 500*d* is integrated with the shell 500*a*, the shell 500*d* is improved in prying resistance.

Moreover, the latch pieces 500*g*, 500*h* are arranged on the first and second end sides in the first direction X of the second connecting portion 120*b*, the release lever 500*e* lies outside the side wall 520*b* of the shell 500*b* with clearance, the release lever 500*f* lies outside the side wall 530*b* of the shell 500*b* with clearance, and the operation buttons 631*a*, 641*a* are arranged outside the release levers 500*e*, 500*f*. That is, the latch pieces 500*g*, 500*h*, the operation buttons 631*a*, 641*a*, and the release levers 500*e*, 500*f* are arranged along the first direction X (width direction) of the plug P, it is possible to minimize the thickness of the plug P, as compared with a plug having latch pieces, release levers and operation buttons arranged along the third direction Z (i.e., thickness direction). Moreover, in a plug having operation buttons arranged along the thickness direction, if such plug is connected to a receptacle installed in electronic equipment placed on a table or the like, the operation buttons may hit the table. The table may apply external force on the operation buttons, and the external force may cause inadvertent slip-off of latch pieces from the locking holes of the slot. This is in contrast with the plug P with the operation buttons 631*a*, 641*a* provided along the width direction, free from concern for inadvertent slip-off of the claws 520*g*, 520*h* of the latch pieces 500*g*, 500*h* from the first and second locking holes of the second slot β if the plug P hits the table. Still advantageously, the plug P includes connection structures of two types corresponding to the HDMI type D standard and another standard. As such, the other connection structure can supply power for the connection structure (the first connecting portion 120*a* and the contacts 200*a*) of the HDMI type D standard that may be used for performing input/output of video or other signals, free from concern for the power consumption of the connection structure for the HDMI type D standard.

The plug P is not limited to the above-described embodiment, but it may be modified in design within the scope of claims. Examples of modifications are described more in detail below.

The body 100 may be attached with the circuit board 300 as in the above-described embodiment, but it may be modified in design as desired, as long as including the main body and the first and second connecting portions projecting from the main body and adjacent to each other in the first direction. In the case where the circuit board 300 is omitted, the cores of the signal lines of the first and second cables 400*a*, 400*b* may be connected by soldering directly to the rear end portions of the contacts 200*a*, 200*b*. Moreover, the slit 111 may be provided in the main body 110 as in the above-described embodiment or may be omitted. If the slit 111 is omitted, the second end portion 532*e* of the bridge 530*e* may be arranged at any position between the first and second connecting portions 120*a*, 120*b* (i.e., in a space between the shells 500*c* and 500*d*).

The shells 500*a*, 500*b* may be of any shapes that can cover the outer circumference of the main body of the body. For example, only one of the shells 500*a*, 500*b* has side walls covering opposite sides in the first direction of the main body of the body.

The shell 500*d* may or may not be configured as in the above embodiment. More particularly, the first and second end portions in the first direction X of the shell body 510*d* may be opened as in the above embodiment, or it may be of such a structure as to cover the first and second end portions in the first direction X of the second connecting portion 120*b*. Moreover, the contact plate 530*d* of the shell 500*d* may be omitted. In this case, the shells 500*a*, 500*b* may be brought into contact with each other, or the shell 500*c* may be brought into contact with the shells 500*a*, 500*b*. Also, the shell 500*c* may have the first and second contact plates 520*c*, 530*c* to contact the shells 500*a*, 500*b* as in the above-described embodiment, but the shell 500*c* only needs to contact at least one of the shells 500*a*, 500*b*. The first and second contact plates 520*c*, 530*c* and the contact plate 530*d* may be modified in shape, as long as they are contactable with the contact targets. The joining plate 520*d* may be of any shape adapted for coupling to the shell 500*a*.

The shell 500*b*, the release levers 500*e*, 500*f* and the latch pieces 500*g*, 500*h* may or may not be made of a sheet of metal plate. For examples, the release levers 500*e*, 500*f* and the latch pieces 500*g*, 500*h* may be separately provided from the shell 500*b*, and the release levers 500*e*, 500*f* and the latch pieces 500*g*, 500*h* may be provided in the shell 500*a*. Alternatively, it is possible to omit the release levers 500*e*, 500*f* and only provide the latch pieces 500*g*, 500*h* integrally with the shell 500*b* or the shell 500*a*. It is also possible to omit the release levers 500*e*, 500*f* and provide the latch pieces 500*g*, 500*h* separately from the shells 500*a*, 500*b*.

The first and second locking pieces may or may not be the latch pieces 500*g*, 500*h* having the claws 520*g*, 520*h*. If claws are provided in a mating connector, locking holes for locking the claws may be provided at the front ends of the first and second locking pieces. The latch pieces 500*g*, 500*h* of the above embodiment is configured such that their claws 520*g*, 520*h* are fitted in the first and second locking holes of the receptacle R and are locked in the fully-latched state. Alternatively, the latch pieces may be configured such that their claws are locked in the locking holes in a half-latched state. Moreover, the first and second locking pieces may be omitted if deemed unnecessary.

The release lever 500*e* of the above embodiment includes the folded-back portion 510*e*, the arm 520*e*, and the bridge 530*e*. However, the release lever 500*e* may be modified in design, as long as it connects between the shell 500*a* or 500*b* and the first locking piece, lies with a clearance from the first side wall of the shell 500*a* or 500*b*, and can be displaced toward the first side wall. Accordingly, the release lever 500*e* may be provided separately from the shell 500*b* and the latch piece 500*g* and attached to the shell 500*b* and the latch piece 500*g*. The folded-back portion 510*e* may be provided continuously to the second end portion 512*b* of the base 510*b* of the shell 500*b*, or it may be provided continuously to the second end portion in the second direction Y of the side wall 520*b* of the shell 500*b*. The folded-back portion 510*e* may also be provided continuously to the shell 500*a*.

The release lever 500*f* of the above embodiment has the folded-back portion 510*f* and the arm 520*f*. However, the release lever 500*f* may be modified in design, as long as it connects between the shell 500*a* or 500*b* and the second locking piece, lies with a clearance from the second side wall of the shell 500*a* or 500*b*, and can be displaced toward the second side wall. Accordingly, the release lever 500*f* may be provided separately from the shell 500*b* and the latch piece 500*h* and attached to the shell 500*b* and the latch piece 500*h*. The folded-back portion 510*f* may be provided continuously to the second end portion of the side wall 530*b* of the shell 500*b*, or alternatively it may be provided continuously to the second end portion 512*b* of the base 510*b* of the shell 500*b*. The folded-back portion 510*f* may also be provided continuously to the shell 500*a*.

The plug P of the invention may or may not include the first and second cables 400*a*, 400*b*. The cables may be omitted if the present invention is applied to a receptacle connector as described later.

The first resin case 600*a* of the above embodiment has the operation buttons 631*a*, 641*a*. However, the operation buttons 631*a*, 641*a* may be omitted if the release levers are omitted as described above. Moreover, in the case where the present invention is applied to a receptacle connector, the first and second resin cases 600*a*, 600*b* may be omitted.

The materials, shapes, numbers, dimensions etc. of the respective elements of the plug connector of the embodiment have been described by way of example only, and they may be modified in design in any manner as long as they provide similar functions. The present invention can be applied not only to plug connectors but also to receptacle connectors. Moreover, the connector of the present invention is connectable to a mating connector with the first and second slots completely partitioned, but it may also be connected to a mating connector with the first and second slots not completely partitioned.

REFERENCE SIGNS LIST

P plug
100 body
- 110 main body
  - 111 slit
- 120*a* first connecting portion
- 120*b* second connecting portion

200*a* contact
200*b* contact
300 circuit board
400*a* first cable
400*b* second cable
500 shield case
- 500*a* shell (first shell)
  - 510*a* base plate (base)
  - 520*a* side wall (first side wall)
  - 530*a* side wall (second side wall)
- 500*b* shell (second shell)
  - 510*b* base plate (base)
  - 520*b* side wall (first side wall)
  - 530*b* side wall (second side wall)
- 500*c* shell (third shell)
  - 510*c* shell body
  - 520*c* first contact plate (contact portion)
  - 530*c* second contact plate (contact portion)
- 500*d* shell (fourth shell)
  - 510*d* shell body
  - 520*d* joining plate (joining portion)
  - 530*d* contact plate (contact portion)
- 500*e* release lever (first release lever)
  - 510*e* folded-back portion (first folded-back portion)
  - 520*e* arm (first arm)
  - 530*e* bridge
- 500*f* release lever (second release lever)
  - 510*f* folded-back portion (second folded-back portion)
  - 520*f* arm (second arm)
- 500*g* latch piece (first locking piece)
- 500*h* latch piece (second locking piece)

600*a* first resin case (first case)
- 631*a* operation button (first operation button)
- 641*a* operation button (second operation button)

600*b* second resin case (second case)
X first direction
Y second direction
Z third direction

The invention claimed is:

1. A shield case to cover a body, the body having a main body and first and second connecting portions projecting from the main body and lying adjacent to each other along a first direction, the shield, case comprising:

first and second shells, having conductive properties and being adapted to cover an outer circumference of the main body;

a third shell, having a conductive property, being adapted to cover the first connecting portion, and being in contact with at least one of the first and second shells; and a fourth shell, having a conductive property, being adapted to cover the second connecting portion, being provided integrally with the first shell, and being adjacent to the third shell along the first direction, and wherein:

the first or fourth shell is in contact with the second shell, and the third and fourth shells are structurally independent from each other.

2. The shied case according to claim 1, wherein the first and second shells each include a base, the base including first and second ends in the first direction and first and second ends in a second direction perpendicular to the first direction, the third shell includes:

a shell body of tuboid shape, adapted to cover the first connecting portion; and a contact portion, being provided in the shell body and in contact with the first end in the second direction of the base of at least one of the first and second shells, and the fourth shell includes:

a shell body, adapted to cover the second connecting portion; and a joining portion, joining the shell body of the forth shell and the first end in the second direction of the base of the first shell.

3. The shield case according to claim 2, wherein the main body of the body includes first and second surfaces that are opposed along a third direction perpendicular to the first and second directions, at least one of the first and second shells further includes first and second side walls, the first and second side walls standing upright at the first and second ends in the first direction of the base of at least one of the first and second shells, the base of the first shell is abuttable on the first surface of the main body, and the base of the second shell is abuttable on the second surface of the main body.

4. The shield case according to claim 2, wherein the fourth shell further includes a contact portion provided at the shell body of the fourth shell, the contact portion being in contact with the first end in the second direction of the second shell.

5. The shield case according to claim 1, further comprising:

a first locking piece, provided on one side in the first direction of the fourth shell; and a second locking piece, provided on the other side in the first direction of the fourth shell.

6. The shield case according to claim 5, wherein the first and second locking pieces are provided integrally with the first or second shell.

7. The shield case according to claim 5, wherein the fourth shell includes first and second end portions in the first direction, the first and second end portions including openings, and the first and second locking pieces are adapted to face first and second ends in the first direction of the second connecting portion of the body.

8. The shield case according to claim 1, the body including a locking projection, wherein a cut-away or a locking hole for locking the locking projection is formed in at least one of the first, second, third and fourth shells.

9. The shield case according to claim 1, the body including a locking hole, wherein a locking projection adapted to be locked in the locking hole is provided on at least one of the first, second, third and fourth shells.

10. A connector comprising:

the shield case according to claim 1;

the body, including the main body and the first and second connecting portions projecting from the main body and lying adjacent to each other along the first direction;

a plurality of first contacts, arrayed in the first and connecting portion; and a plurality of second contacts, arrayed in the second and connecting portion.

11. The connector according to claim 10 being a plug connector, further comprising:

a circuit board, provided in the main body of the body and connected to the first and second contacts;

a cable, including a board-connectable portion adapted to be connected to the circuit board; and first and second cases having insulating properties, the first and second cases in combination being adapted to cover the first and second shells, wherein the first and second shells of the shield case are adapted to cover, in addition to the main body of the body, the outer circumference of the circuit board and the board-connectable portion of the cable.

12. The shield case according to claim 1, wherein the third shell is structurally independent from the first, second, and fourth shells.

13. A shield case to cover a body, the body having a main body and first and second connecting portions projecting from the main body and lying adjacent to each other along a first direction, the shield case comprising:

first and second shells, having conductive properties and being adapted to cover an outer circumference of the main body;

a third shell, having a conductive property being adapted to cover the first connecting portion, and being in contact with the first and second shells; and a fourth shell, having a conductive property, being adapted to cover the second connecting portion, being provided integrally with the first shell, and being adjacent to the third shell along the first direction, wherein:

the third and fourth shells are structurally independent from each other.

14. The shield case according to claim 13, further comprising:

a first locking piece, provided on one side in the first direction of the fourth shell; and a second locking piece, provided on the other side in the first direction of the fourth shell.

15. The shield case according to claim 14, wherein the first and second locking pieces are provided integrally with the first or second shell.

16. The shield case according to claim 14, further comprising:

a first release lever, connecting between the first or second shell and the first locking piece; and a second release lever, connecting between the first or second shell and the second locking piece, wherein the first or second shell includes first and second ends in the first direction, first and second ends in a second direction perpendicular to the first direction, and first and second side walls provided at the first and second ends in the first direction, and the first and second release levers are arranged with clearances from the first and second side walls and are movable toward the first and second side walls.

17. The shield case according to claim 16, wherein the second release ever includes:

a second folded-back portion, being provided integrally with the second end in the second direction of the first or second shell and folded back toward the first end in the second direction thereof; and a second arm, being provided integrally with the second folded-back portion and is disposed with a clearance from the second side wall, the second arm including first and second ends in the second direction, the first release lever includes:

a first folded-back portion, being provided integrally with the second end in the second direction of the first or second shell and folded back toward the first end in the second direction thereof, a first arm, being provided integrally with the first folded-back portion and is disposed with a clearance from the first side wall; and a bridge, extending from the first arm into a space formed between the third and fourth shells, the bridge including a first end provided integrally with the first arm and a second end disposed in the space, and the second locking piece is provided integrally with the first end of the second arm, and the first locking piece is provided integrally with the second end of the bridge.

18. The shield case according to claim 16, wherein the body includes a slit communicating with a space between the third and fourth shells, the second release lever includes:

a second folded-back portion, being provided integrally with the second end in the second direction of the first or second shell and folded back toward the first end in the second direction thereof; and a second arm, being provided integrally with the second folded-back portion and is disposed with a clearance from the second side wall, the second arm including first and second ends in the second direction, the first release lever includes:

a first folded-back portion, being provided integrally with the second end in the second direction of the first or second shell and folded back toward the first end in the second direction thereof, a first arm, being provided integrally with the first folded-back portion and is disposed with a clearance from the first side wall; and a bridge, extending from the first arm into the slit, the bridge including a first end provided integrally with the first arm and a second end disposed in the slit, and the second locking piece is provided integrally with the first end of the second arm, and the first locking piece is provided integrally with the second end of the bridge.

19. A connector comprising:

the shield case according to claim 16;

the body, including the main body and the first and second connecting portions projecting from the main body and lying adjacent to each other along the first direction;

a plurality of first contacts, arrayed in the first and connecting portion; and a plurality of second contacts, arrayed in the second and connecting portion.

20. The connector according to claim 19 being a plug connector, further comprising:

a circuit board, provided in the main body of the body and adapted for connection with the first and second contacts;

a cable, including a board-connectable portion adapted to be connected to the circuit board; and first and second cases having insulating properties, the first and second cases in combination being adapted to cover the first and second shells, wherein the first and second shells of the shield case are adapted to cover, in addition to the main body of the body, the outer circumference of the circuit board and the board-connectable portion of the cable, and the first or second case includes first and second operation buttons to displace the first and second release levers toward the first and second side walls of the first or second shell.

21. The shield case according to claim 14, wherein the fourth shell includes first and second end portions in the first direction, the first and second end portions including openings, and the first and second locking pieces are adapted to face first and second ends in the first direction of the second connecting portion of the body.

22. The shield case according to claim 5, further comprising:

a first release lever, connecting between the first or second shell and the first locking piece; and a second release lever, connecting between the first or second shell and the second locking piece, wherein the first or second shell includes first and second ends in the first direction, first and second ends in a second direction perpendicular to the first direction, and first and second side walls provided at the first and second ends in the first direction, and the first and second release levers are arranged with clearances from the first and second side walls and are movable toward the first and second side walls.

23. The shield case according to claim 22, wherein the second release lever includes:

a second folded-back portion, being provided integrally with the second end in the second direction of the first or second shell and folded back toward the first end in the second direction thereof; and a second arm, being provided integrally with the second folded-back portion and is disposed with a clearance from the second side wall, the second arm including first and second ends in the second direction, the first release lever includes:

a first folded-back portion, being provided integrally with the second end in the second direction of the first or second shell and folded back toward the first end in the second direction thereof, a first arm, being provided integrally with the first folded-back portion and is disposed with a clearance from the first side wall; and a bridge, extending from the first arm into a space formed between the third and fourth shells, the bridge including a first end provided integrally with the first arm and a second end disposed in the space, and the second locking piece is provided integrally with the first end of the second arm, and the first locking piece is provided integrally with the second end of the bridge.

24. The shield case according to claim 22, wherein the body includes a slit communicating with a space between the third and fourth shells, the second release lever includes:

a second folded-back portion, being provided integrally with the second end in the second direction of the first or second shell and folded back toward the first end in the second direction thereof; and a second arm, being provided integrally with the second folded-back portion and is disposed with a clearance from the second side wall, the second arm including first and second ends in the second direction, the first release lever includes:

a first folded-back portion, being provided integrally with the second end in the second direction of the first or second shell and folded back toward the first end in the second direction thereof, a first arm, being provided integrally with the first folded-back portion and is disposed with a clearance from the first side wall; and a bridge, extending from the first arm into the slit, the bridge including a first end provided integrally with the first arm and a second end disposed in the slit, and the second locking piece is provided integrally with the first end of the second arm, and the first locking piece is provided integrally with the second end of the bridge.

25. A connector comprising:

the shield case according to claim 22;

the body, including the main body and the first and second connecting portions projecting from the main body and lying adjacent to each other along the first direction;

a plurality of first contacts, arrayed in the first and connecting portion; and a plurality of second contacts, arrayed in the second and connecting portion.

26. The connector according to claim 25 being a plug connector, further comprising:

a circuit board, provided in the main body of the body and adapted for connection with the first and second contacts;

a cable, including a board-connectable portion adapted to be connected to the circuit board; and first and second cases having insulating properties, the first and second cases in combination being adapted to cover the first and second shells, wherein the first and second shells of the shield case are adapted to cover, in addition to the main body of the body, the outer circumference of the circuit board and the board-connectable portion of the cable, and the first or second case includes first and second operation buttons to displace the first and second release levers toward the first and second side walls of the first or second shell.

27. The shield case according to claim 13, the body including a locking projection, wherein a cut-away or a locking hole for locking the locking projection is formed in at least one of the first, second, third and fourth shells.

28. The shield case according to claim 13, the body including a locking hole, wherein a locking projection adapted to be locked in the locking hole is provided on at least one of the first, second, third and fourth shells.

29. A connector comprising:

the shield case according to claim 13;

the body, including the main body and the first and second connecting portions projecting from the main body and lying adjacent to each other along the first direction;

a plurality of first contacts, arrayed in the first and connecting portion; and a plurality of second contacts, arrayed in the second and connecting portion.

30. The connector according to claim 29 being a plug connector, further comprising:

a circuit board, provided in the main body of the body and connected to the first and second contacts;

a cable, including a board-connectable portion adapted to be connected to the circuit board; and first and second cases having insulating properties, the first and second cases in combination being adapted to cover the first and second shells, wherein the first and second shells of the shield case are adapted to cover, in addition to the main body of the body, the outer circumference of the circuit board and the board-connectable portion of the cable.

31. The shield case according to claim 13, wherein the third shell is structurally independent from the first, second, and fourth shells.

* * * * *